US006556123B1

(12) United States Patent
Iwao et al.

(10) Patent No.: US 6,556,123 B1
(45) Date of Patent: Apr. 29, 2003

(54) POLYMER CHIP PTC THERMISTOR

(75) Inventors: Toshiyuki Iwao, Osaka (JP); Junji Kojima, Osaka (JP); Akira Tanaka, Kyoto (JP); Takashi Ikeda, Osaka (JP); Kiyoshi Ikeuchi, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/936,191

(22) PCT Filed: Mar. 2, 2000

(86) PCT No.: PCT/JP00/01228

§ 371 (c)(1),
(2), (4) Date: Jan. 2, 2002

(87) PCT Pub. No.: WO00/54290

PCT Pub. Date: Sep. 14, 2000

(30) Foreign Application Priority Data

Mar. 8, 1999 (JP) ..... 11-059783
Jun. 22, 1999 (JP) ..... 11-175006

(51) Int. Cl.[7] ..... H01C 7/13

(52) U.S. Cl. ..... 338/22 R; 338/22 SD; 338/254; 338/260

(58) Field of Search ..... 338/22 R, 22 SD, 338/319, 320, 254, 260

(56) References Cited

U.S. PATENT DOCUMENTS 6,157,289 A * 12/2000 Kojima et al. ..... 338/22 R

FOREIGN PATENT DOCUMENTS

| | | | | |
|---|---|---|---|---|
| JP | 6-61014 | | 3/1994 | |
| JP | 6-44101 | | 6/1994 | |
| JP | 6-208903 | * | 7/1994 | ..... 338/22 SD |
| JP | 9-503097 | | 3/1997 | |
| WO | 98/12715 | | 3/1998 | |

OTHER PUBLICATIONS

Japanese search report for PCT/JP00/01228 dated Jun. 6, 2000.

English translation of Form PCT/ISA/210, Jun. 6, 2000.

* cited by examiner

*Primary Examiner*—Karl D. Easthom
(74) *Attorney, Agent, or Firm*—RatnerPrestia

(57) ABSTRACT

A chip PTC thermistor is provided which is capable of increasing the rate of increase in resistance when an overcurrent is applied, thereby increasing the breakdown voltage. The PTC thermistor comprises: a first main electrode and a first sub-electrode disposed on a first face of a conductive polymer with PTC properties; a second main electrode and a second sub-electrode disposed on a second face of the conductive polymer, which is facing the first face; and first and second side electrode and disposed on side faces of the conductive polymer. Cut-off sections are provided to the vicinity of joints of the first main electrode and the first side electrode, and joints of the second main electrode and the second side electrode.

3 Claims, 19 Drawing Sheets

POLYMER CHIP PTC THERMISTOR

This Application is a U.S. National Phase Application of PCT International Application PCT/JP00/01228.

FIELD OF THE INVENTION

The present invention relates to a chip positive temperature coefficient (hereinafter, PTC) thermistor comprising conductive polymers having PTC properties.

BACKGROUND OF THE INVENTION

When overcurrent is applied in an electric circuit, conductive polymers with PTC properties spontaneously heat up and thermally expand to become a high resistance polymers, thereby lowering the current to a safe low-current level. As such, PTC thermistors can be used as an overcurrent protection element.

One of the conventional chip PTC thermistor configurations is disclosed in the Published Japanese Translation of PCT Publication No. H09-503097. FIG. 18(*a*) is a sectional view of the conventional chip PTC thermistor, and FIG. 18(*b*), a top view. The PTC thermistor comprises:

a resistive element 1 which is made with conductive polymer having PTC properties;

electrodes 2*a* and 2*b,* and 2*c* and 2*d* made with metal foil formed respectively on the front and back faces of the resistive element 1;

a pair of through-holes 3 having openings 3*a* and 3*b* which penetrate through the resistive element 1; and conductive members 4*a* and 4*b* formed by plating on the internal walls of the through-holes 3 in such a manner that they electrically connect the electrodes 2*a* and 2*d,* and 2*b* and 2*c*.

Another chip PTC thermistor which achieves soldered sections when mounted on a circuit board and allows flow soldering. As shown in FIG. 19(*a*), a perspective view, FIG. 19(*b*), a sectional view, and FIG. 19(*c*), exploded perspective view, the chip PTC thermistor comprises;

a conductive polymer sheet 5 having PTC properties;

electrodes 6*a* and 6*b,* and 6*c* and 6*d* made with metal foil formed respectively on the front and back faces of the conductive polymer 5; and side face electrodes 7*a* and 7*b* formed by plating on the side faces of the conductive polymer 5 in such a manner that they electrically connect the electrodes 6*a* and 6*d,* and 6*b* and 6*c*. The conductive polymer 5 is a mixture of polymeric materials such as polyethylene and carbon black.

The conductive polymer 5 of the PTC thermistor expand spontaneously due to the heat (heat energy $P=I^2\times R$, I: current, R: PTC thermistor resistance) generated when overcurrent is applied, resistance. In the case of the chip PTC thermistor of the present invention, the electrodes 6*a* and 6*c* restrict expansion of the conductive polymer sheet 5 in the perpendicular direction, the same direction of the current passage. This prevents the rate of increase in resistance of the PTC thermistor from increasing to the capacity of the conductive polymer 5. Consequently, the range of the increase in resistance, keeps the balance of the power consumption ($P=V^2/R$, V: applied voltage), low, thereby preventing the voltage from rising.

SUMMARY OF THE INVENTION

The chip PTC thermistor of the present invention comprises;

a conductive polymer having PTC properties;

a first main electrode disposed on and in contact with the conductive polymer;

a second main electrode disposed sandwiching the conductive polymer with the first main electrode;

a first electrode electrically connected to the first main electrode;

a second electrode electrically connected to the second main electrode; and a means for releasing restriction against deformation comprising a cut-off section or a opening, disposed at least on one of the first and second main electrodes.

Since this construction comprises the means for releasing restriction against deformation, expansion of the conductive polymer to the perpendicular direction can be facilitated when overcurrent is applied to the chip PTC thermistor. As such, the resistivity of the conductive polymer increases, pushing up the rate of increase in resistance. Therefore, performance of the chip PTC thermistor in increasing resistance improves, thereby enhancing withstand voltage.

As the need arises, odd or even-numbered inner electrodes can be disposed in between the first and second main electrodes.

In the case of the chip PTC thermistor of the present invention, it is desirable to dispose the means for releasing restriction against deformation in the vicinity of the joints between the main electrodes and the first and second electrodes, in such a manner that each of the adjacent means being disposed symmetrically to the center of the space between the first and second electrodes. This construction allows the conductive polymer to expand more easily, thus further facilitating increases in its resistance and withstand voltage.

The means for releasing restriction against deformation formed on the main electrode should be preferably disposed rotationally symmetrically on a face parallel to the main electrode. This construction averages the distortion of the PTC thermistor caused by the expansion of the conductive polymer, thereby enhancing reliability.

The means for releasing restriction against deformation should preferably be made with an opening or a cut-off section. The opening or a cut-off section helps the conductive polymer to expand, thus further facilitating increases in resistance.

According to the chip PTC thermistor of the present invention, it is preferable to provide a first sub-electrode on a same plane of the first main electrode in such a manner that the first sub-electrode is electrically separated from the first main electrode and electrically connected to the second electrode.

Preferably, the first electrode is a first side electrode disposed on one of the side faces of the conductive polymer while the second electrode is a second side electrode disposed on the other side face of the conductive polymer.

The first and second electrodes can be respectively first and second internal through electrodes penetrating through the conductive polymer.

The first electrode can also comprise the first side electrode disposed on one of the side faces of the conductive polymer and the first internal through electrode penetrating through the conductive polymer while the second electrode comprises the second side electrode disposed on the other side face of the conductive polymer and the second internal through electrode penetrating through the conductive polymer as well.

BRIEF DESCRIPTION OF THE DRAWINGS

FIG. 1(*b*) is an exploded perspective view of the chip PTC thermistor in accordance with the first preferred embodiment of the present invention.

FIG. 1(*c*) is a sectional view sectioned at the 1C—1C line of FIG. 1(*a*).

FIG. 2(*b*) is an exploded view of a PTC thermistor showing process steps for forming the chip in accordance with the first preferred embodiment of the present invention.

FIG. 2(*c*) is an exploded view of a PTC thermistor showing process steps for forming the chip in accordance with the first preferred embodiment of the present invention.

FIG. 3(*b*) is an exploded view of a PTC thermistor showing process steps for forming the chip in accordance with the first preferred embodiment of the present invention.

FIG. 3(*c*) is an exploded view of a PTC thermistor showing process steps for forming the chip in accordance with the first preferred embodiment of the present invention.

FIG. 3(*d*) is an exploded view of a PTC thermistor showing process steps for forming the chip in accordance with the first preferred embodiment of the present invention.

FIG. 5(*b*) is an exploded perspective view of the chip PTC thermistor in accordance with the first preferred embodiment of the present invention.

FIG. 5(*c*) is a sectional view section at the 5(*c*)—5(*c*) line of FIG. 5(*a*).

FIG. 6(*b*) is a plan view of the chip PTC thermistor.

FIG. 7(*b*) is an exploded perspective view of the chip PTC thermistor in accordance with the second preferred embodiment of the present invention.

FIG. 7(*c*) is a sectional view sectioned at the 7(*c*)—7(*c*) line of FIG. 7(*a*).

FIG. 8(*b*) show manufacturing process steps for forming the chip PTC thermistor in accordance with the second preferred embodiment of the present invention.

FIG. 9(*b*) is an exploded perspective view of the chip PTC thermistor in accordance with the second preferred embodiment of the present invention.

FIG. 9(*c*) is a sectional view sectioned at the 9(*c*)—9(*c*) line of FIG. 9(*a*).

FIG. 10(*b*) is an exploded perspective view of the chip PTC thermistor in accordance with the second preferred embodiment of the present invention.

FIG. 10(*c*) is a sectional view sectioned at the 10(*c*)—10(*c*) line of FIG. 10(*a*).

FIG. 11(*b*) is an exploded perspective view of the chip PTC thermistor in accordance with the second preferred embodiment of the present invention.

FIG. 11(*c*) is a sectional view sectioned at the 11(*c*)—11(*c*) line of FIG. 11(*a*).

FIG. 12(*b*) is an exploded perspective view of the chip PTC thermistor in accordance with the third preferred embodiment of the invention.

FIG. 12(*c*) is a sectional view sectioned at the 12(*c*)—12(*c*) line of FIG. 11(*a*).

FIG. 13(*b*) show manufacturing process steps for forming the chip PtC thermistor in accordance with the third preferred embodiment of the present invention.

FIG. 14(*b*) is an exploded perspective view of the chip PTC thermistor in accordance with the third preferred embodiment of the present invention.

FIG. 14(*c*) is a sectional view sectioned at the 14(*c*) line of FIG. 14(*a*).

FIG. 15(*c*) is a sectional view sectioned at the 15(*c*)—15(*c*) line of FIG. 15(*a*).

FIG. 16(*a*) is a perspective view of still another chip PTC thermistor in accordance with the third preferred embodiment of the present invention.

FIG. 16(*c*) is a sectional view sectioned at the 16(*c*)—16(*c*) line of FIG. 16(*a*).

FIG. 17(*b*) is an exploded perspective view of the chip PTC thermistor in accordance with the third preferred embodiment of the present invention.

FIG. 17(*c*) is a sectional view sectioned at the 17(*c*)—17(*c*) line of FIG. 17(*a*).

FIG. 19(*b*) is a sectional view sectioned at the 19(*c*)—19(*c*) line of FIG. 19(*a*).

FIG. 19(*c*) is an exploded perspective view of the same chip PTC thermistor.

DETAILED DESCRIPTION OF THE INVENTION

The First Preferred Embodiment

The chip PTC thermistor of the first preferred embodiment of the present invention is described hereinafter with reference to the accompanying drawings.

Figure 1A:
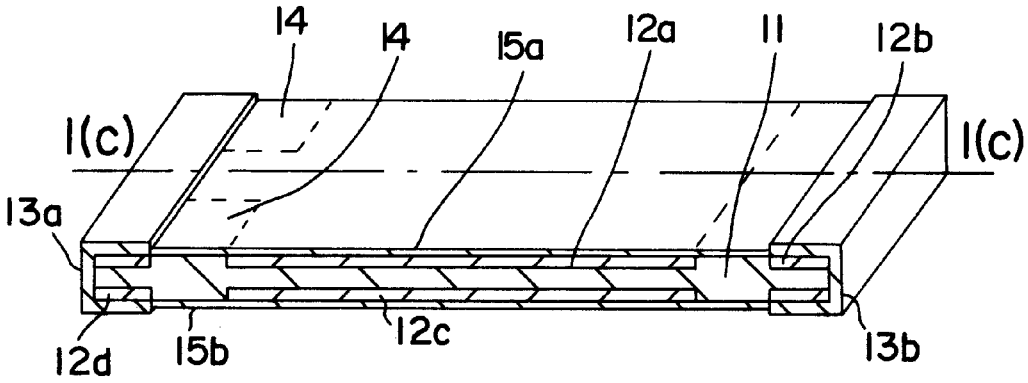
FIG. 1(*a*) is a perspective view of a chip PTC thermistor in accordance with a first preferred embodiment of the present invention.
Figure 1B:
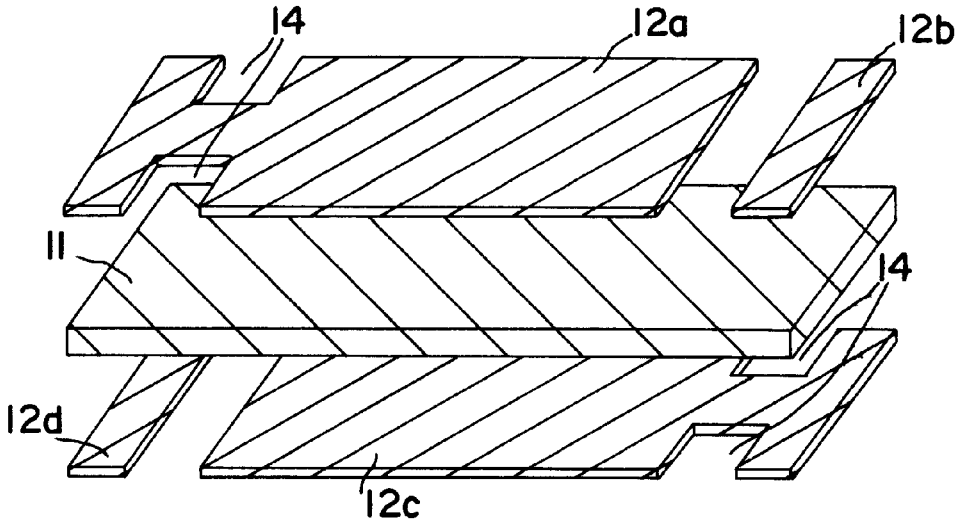
Figure 1C:
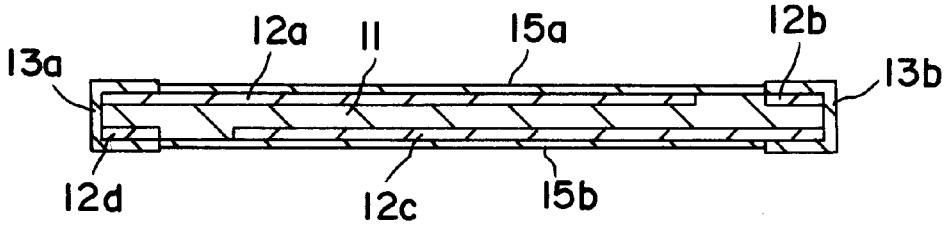

In FIGS. 1(*a*), 1(*b*) and 1(*c*), a rectangular parallelepiped conductive polymer 11 having PTC properties comprises a mixture of a high density polyethylene which is a crystalline polymer, and carbon black, a conductive particle. On a first face of the conductive polymer 11 is a first main electrode 12*a*. Also on the same plane is a first sub-electrode 12*b* which is disposed separately from the first main electrode 12*a*. The same plane as used herein means that the first sub-electrode 12*b* is disposed on an extended plane of the first main electrode 12*a*, and being separate as used herein means that it is not electrically connected to the first main electrode 12*a* directly. Nonetheless, these conditions do not exclude the possibility that the main electrode 12*a* and the sub-electrode 12*b* may be electrically coupled through the conductive polymer 11. A second main electrode 12*c* is disposed on a second face opposite the first face of the conductive polymer 11, and a second sub-electrode 12*d* is disposed separately from and on a same plane with the second main electrode 12*c*. All the main and sub-electrodes 12*a*, 12*b*, 12*c*, and 12*d* comprise a metal foil such as nickel and copper.

A first side electrode 13*a* made with an exemplary nickel plating layer folds around the entire surface of one of side faces of the conductive polymer 11 and edges of the first main electrode 12*a* and the second sub-electrode 12*d* in such a manner that it electrically connects the first main electrode 12*a* and the second sub-electrode 12*d*. A second side electrode 13*b* made with a nickel plating layer folds around the entire surface of the other side face, opposite the first side face electrode 13*a*, of the conductive polymer 11, and the edges of the second main electrode 12*c* and the first sub-electrode 12*b* in such a manner that it electrically connects the second main electrode 12*c* and the first sub-electrode 12*b*. The first and second side electrodes 13*a* and 13*b* are used as first and second electrodes for external connection.

The first and second main electrodes 12*a* and 12*c* have cut-off sections 14. First and second protective coatings 15*a* and 15*b* comprising epoxy-acrylic resins are formed on the outermost layer of the first and second faces of the conductive polymer 11.

The manufacturing method of the chip PTC thermistor constructed in the foregoing manner is described with reference to FIGS. 2(*a*)–(*c*) and FIGS. 3 (*a*)–(*d*).

Firstly, 42 wt % of high density polyethylene having a crystallinity of 70–90%, 57 wt % of carbon black made by furnace method, having an average particle diameter of 58 nm and specific surface area of 38 $m^2/g$, and 1 wt % of anti-oxidant, are kneeded with a heated two-roll mill at ca 170° C. for about 20 minutes. The kneeded mixture is taken out from the roll mill in a form of sheet to obtain a conductive polymer sheet 21 with a thickness of about 0.16 mm shown in FIG. 2(*a*). The conductive polymer 21 in FIG. 2 will become the conductive polymer 11 when completed.

Subsequently, a pattern is formed on an approximately 80 μm thick electrolytic copper foil by a metal mold press to prepare an electrode 22 shown in FIG. 2(*b*). The electrode 22 will become the first main electrode 12*a*, the first sub-electrode 12*b*, the second main electrode 12*c*, and the second sub-electrode 12*d* when completed. A reference numeral 23 in FIG. 2(*b*) is equal to that of the cut-off sections 14 formed on one of or both of the first and second main electrodes 12*a* and 12*c* in the vicinity of the joints with the first and second side electrodes 13*a* and 13*b*. Grooves 24 are formed to provide space between the main and sub-electrodes so that they are separated from one another when a chip PTC thermistor is diced into independent units in the following process. Grooves 25 are formed to reduce sags and flashes of the electrolytic copper foil from occurring during dicing by reducing the cutting length of the electrolytic copper foil.

Figure 2A:
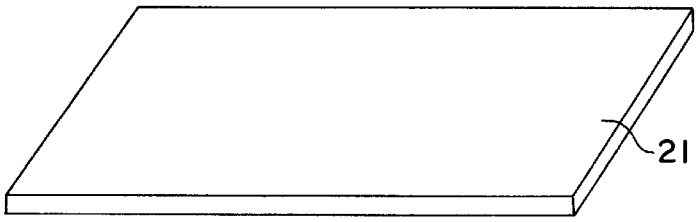
FIG. 2(*a*) is an exploded view of a PTC thermistor showing process steps for forming the chip in accordance with the first preferred embodiment of the present invention.
Figure 2B:
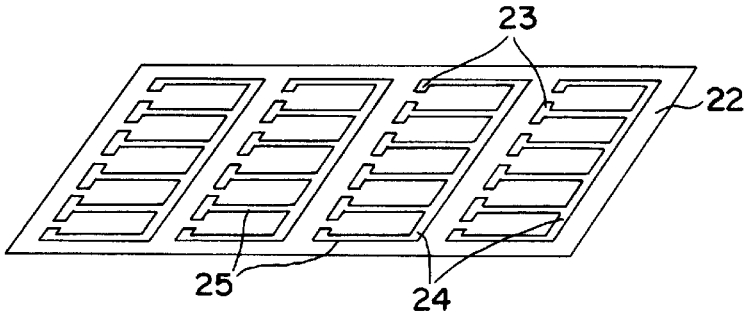
Figure 2C:
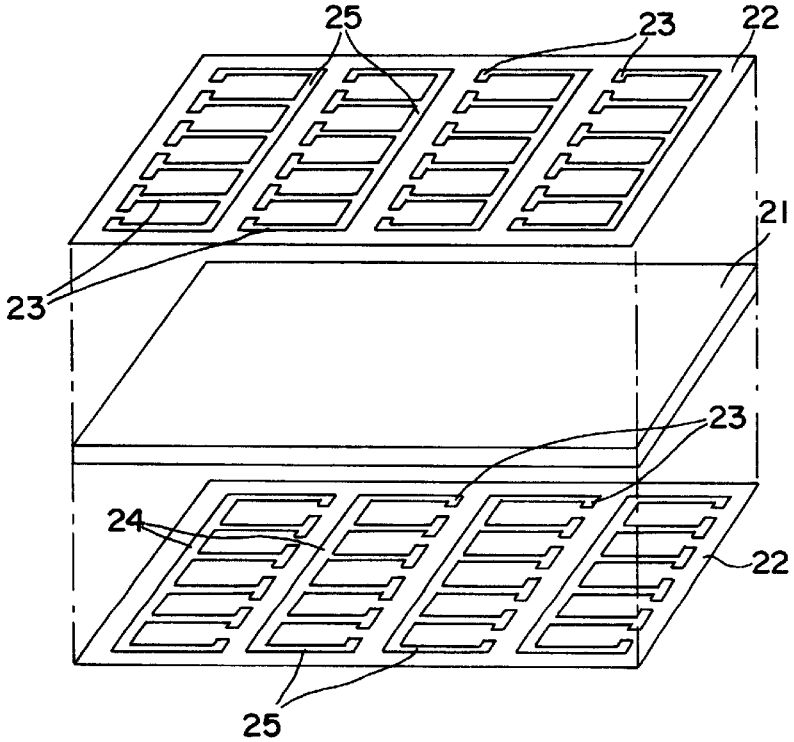
Figure 3A:
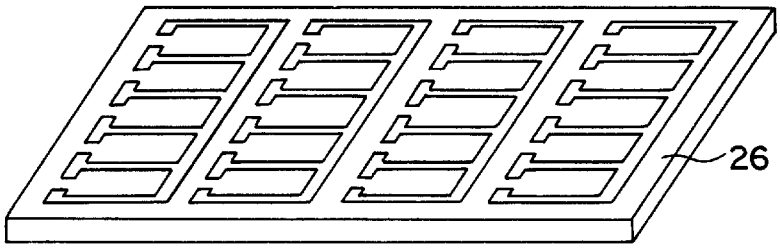
FIG. 3(*a*) is an exploded view of a PTC thermistor showing process steps for forming the chip in accordance with the first preferred embodiment of the present invention.
Figure 3B:
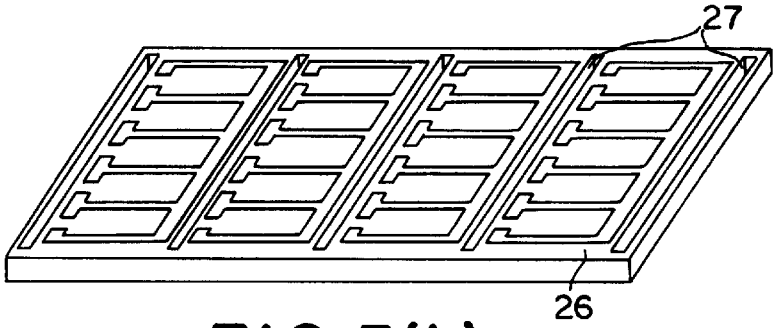
Figure 3C:
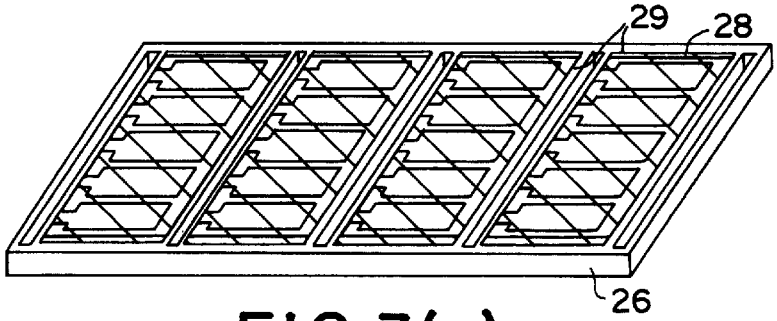
Figure 3D:
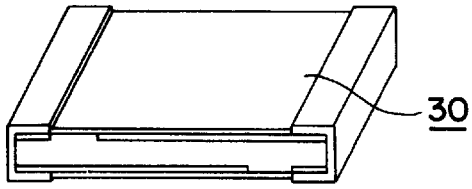

Subsequently, the conductive polymer sheet 21 is sandwiched between the electrodes 22 as shown in FIG. 2(*c*). The laminate is heat press formed under a vacuum of 20 Torr for one minute at 175° C. and a pressure of 75 $kg/cm^2$, and is integrated to form a first sheet 26 shown in FIG. 3(*a*). The first sheet 26 is heat treated at 110–120° C. for one hour and then exposed to an electron beam irradiation of approximately 40 Mrad in an electron beam irradiator to cross-link high density polyethylene.

Then, as FIG. 3(*b*) shows, narrow through-grooves 27 are formed at predetermined regular intervals by dicing, leaving some space between the longitudinal sides of desired chip PTC thermistors and both ends of the through-grooves 24.

Subsequently, as FIG. 3(*c*) shows, epoxy-acrylic, ultraviolet ray and heat curing resins are screen printed on the top and bottom faces of the first sheet 26 with the exception of the vicinity of the through-grooves 27 formed thereon. In a UV curing oven the resins are cured temporarily one face at a time, then the resins on both faces are cured at a same time in a thermosetting oven to form protective coatings 28. Side electrodes 29 which comprise nickel plating layer of approximately 10 μm in thickness, are formed on the portions of the sheet 23 where the protective coatings are not provided and inner walls of the through grooves 24, in a nickel sulfamate bath under a current density of 4 $A/dm^2$ for about 20 minutes.

The first sheet 26 with the side electrodes 29 is then diced into independent units to form chip PTC thermistors 30 shown in FIG. 3(*d*).

The following is the description showing why the cut-off sections are formed on one of or both of the first and second main electrodes in the vicinity of a joint or joints with the first and/or second side electrodes in order to obtain adequate rate of increase in resistance of the chip PTC thermistor. The description is given based on the PTC thermistor 30 as an example.

Figure 19A:
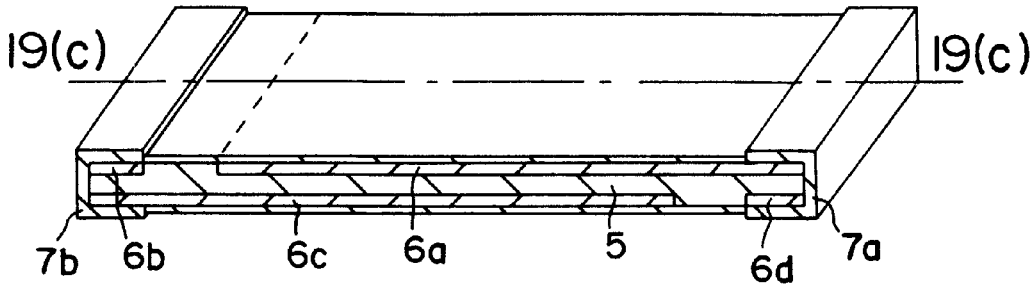
FIG. 19(*a*) is a perspective view of a chip PTC thermistor invented prior to the present invention.
Figure 19B:
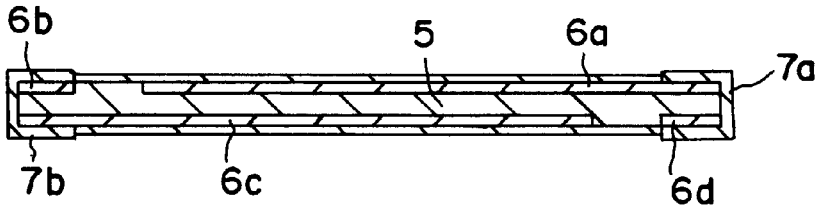
Figure 19C:
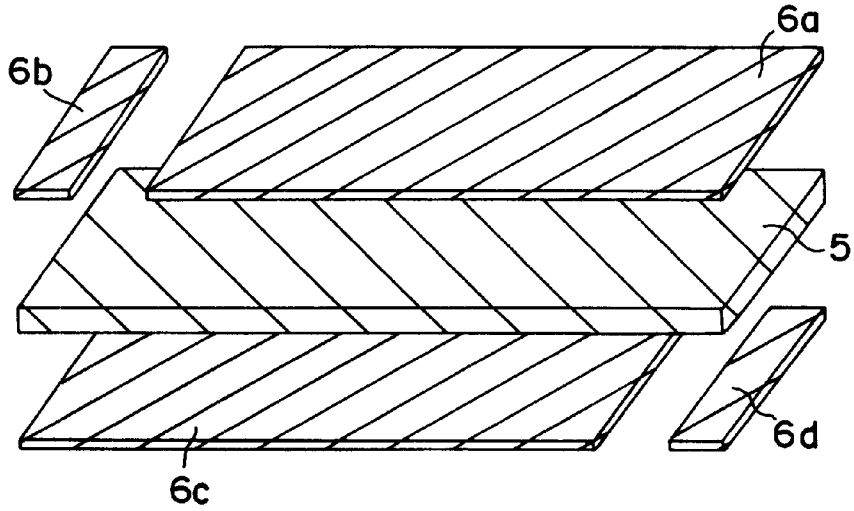

When the PTC thermistor 30 is mounted on a circuit board as a surface mount component, and when an overcurrent is applied, the conductive polymer 11 spontaneously heats up and expands, raising its resistivity, and lowering the overcurrent to an insignificant value. In the case of the chip PTC thermistor described above, since a conductive polymer 5 is sandwiched between electrodes 6*a* and 6*c* as shown in FIG. 19, expansion of the conductive polymer 5 in thickness direction has some difficulty. To address this problem, the first and second main electrodes 12*a* and 12*c* are provided with the cut-off sections 14 respectively in the vicinity of the joint with the first side electrode 13*a* and the second side electrode 13*b* as shown in FIG. 1(*b*). These cut-off sections 14 allow portions sandwiched by them to deform easily, helping the conductive polymer 11 to expand in thickness direction. As a result, the expandability of the conductive polymer can be released adequately, thereby improving the rate of increase in resistance. Therefore, a chip PTC thermistor capable of maintaining a constant power consumption, and of controlling overcurrent without suffering damage even under a high voltage, and with a high withstand voltage, can be obtained. In this embodiment, the cut-off sections 14 are provided to both main electrodes 12*a* and 12*c,* however, it can be provided only to one of main electrodes 12*a* and 12*c.*

According to the manufacturing method of this embodiment, two types of samples are made: a type in which the first and second main electrodes 12*a* and 12*c* are provided with the cut-off sections 14 in the vicinity of the joints with the first side electrodes 13*a* and 13*b,* and another type without the cut-off sections 14. To confirm the differences in the rate of increase in resistance brought about by the cut-off sections 14, the following test is conducted.

Five samples of each of the types with and without cut-off sections 14 are mounted on printed circuit boards and kept in a constant temperature oven. The temperature of the oven is raised at the rate of 2° C./min from 25° C.–150° C. and resistances of the samples are measured at different temperatures.

Figure 4:
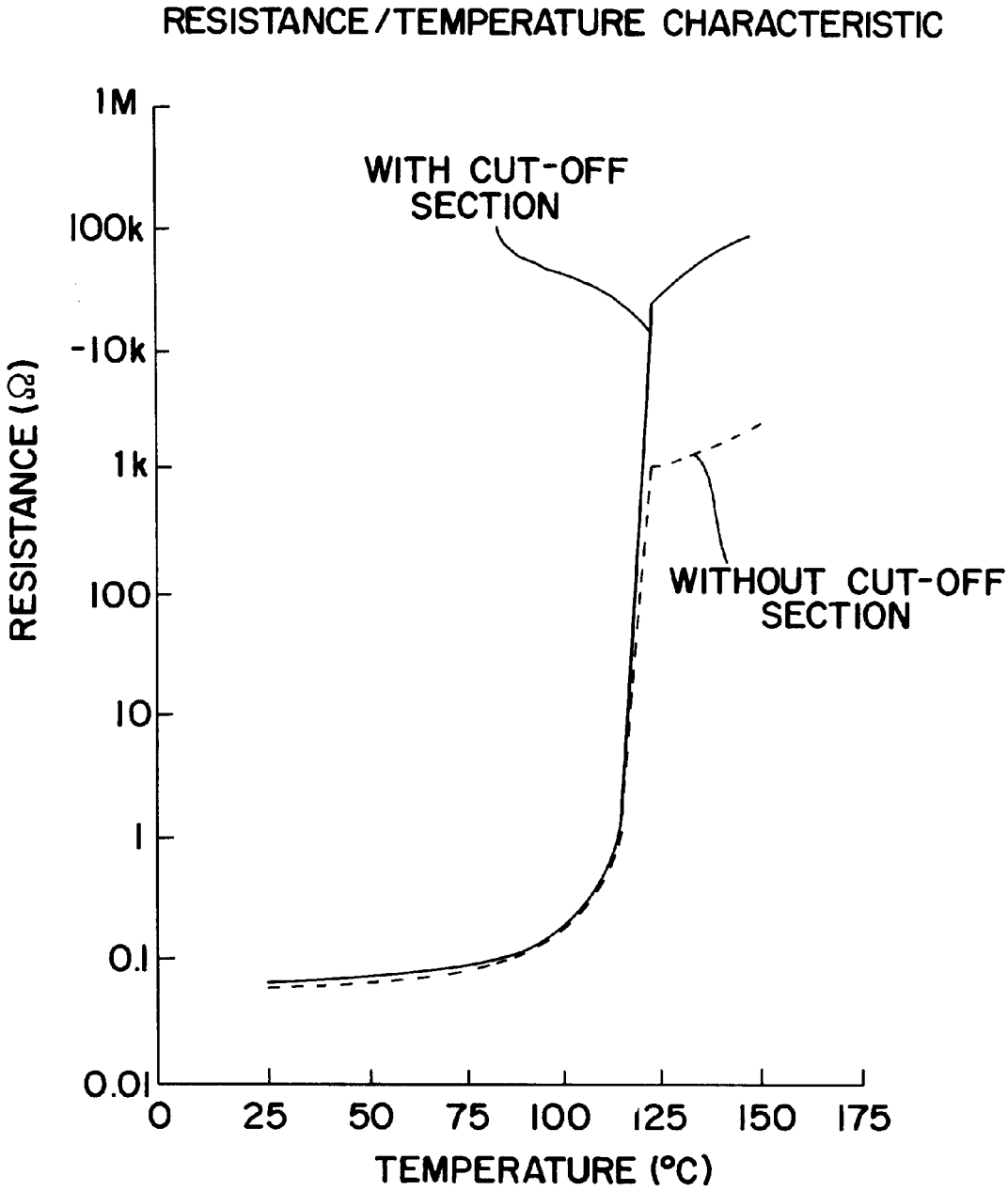
FIG. 4 is a graph showing differences in correlations between resistance and temperature measured when the first and second electrodes are provided with a cut-off section and when they are not provided with any cut-off section.

FIG. 4 shows an example of the resistance/temperature characteristics of the samples with and without the cut-off section 14. As FIG. 4 shows, the samples with the cut-off section 14 have higher resistances than the samples without the cut-off section 14 when the temperature reaches 125° C.

Figure 5A:
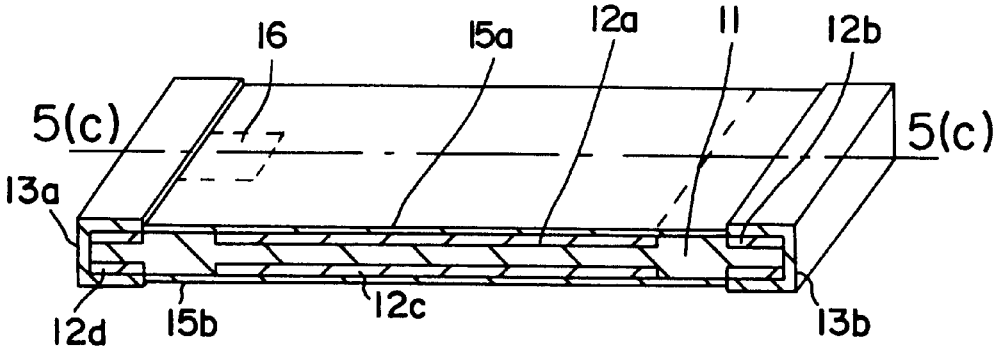
FIG. 5(*a*) is a perspective view of another chip PTC thermistor in accordance with the first preferred embodiment of the present invention.
Figure 5B:
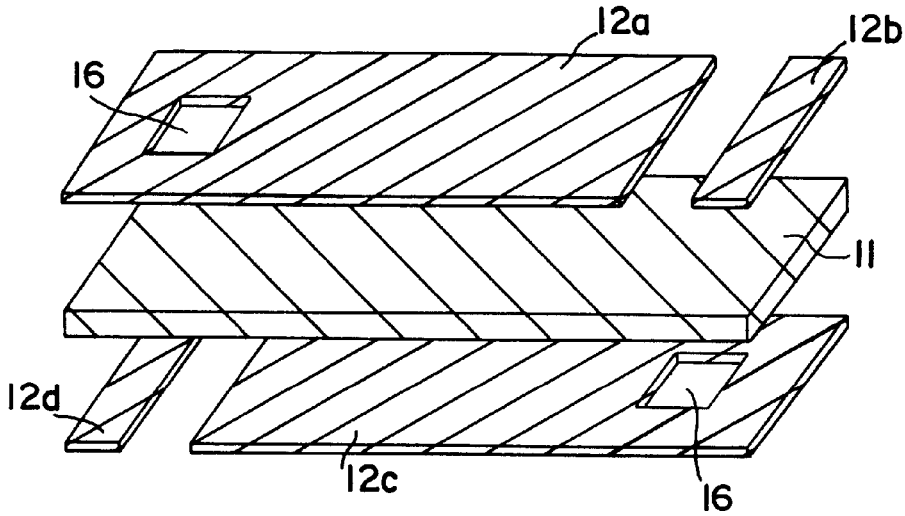
Figure 5C:
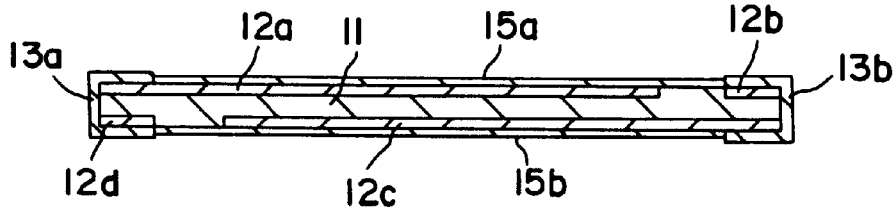

In the first preferred embodiment, the first and second main electrodes 12*a* and 12*c* are provided with the cut-off sections 14, however as shown in FIGS. 5(*a*)–(*c*), when the cut-off sections 14 are replaced with openings 16, the same benefits can be obtained. The cut-off section 14 or the opening 16 can be provided to one of the first and second main electrodes 12*a* and 12*c.* It is also possible to provide the cut-off section 14 on one of the main electrodes 12*a* and 12*c* in the vicinity of the joint with the first and second side electrodes 13*a* and 13*b,* and at least one opening 16 on the other main electrode.

Figure 6A:
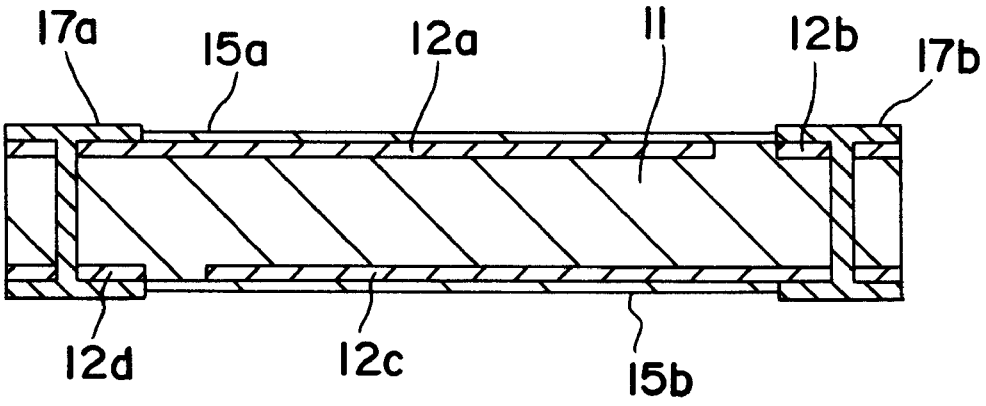
FIG. 6(*a*) is a perspective view of yet another chip PTC thermistor in accordance with the first preferred embodiment of the invention.
Figure 6B:
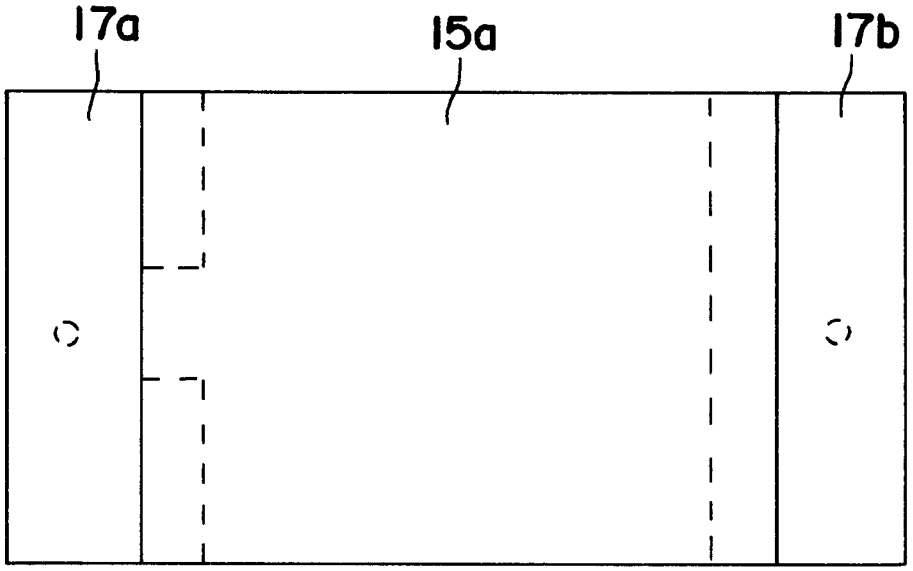

In this embodiment, the first electrode to which the first main electrode 12*a* is connected, is the first side electrode 13*a.* The first electrode is not, however, limited to the electrode disposed over the entire side face of the conductive polymer 11: it can be an electrode formed on part of the side faces of the conductive polymer. As shown in FIGS. 6(*a*) and (*b*), the first electrode can be a first internal through electrode 17*a* which penetrates through inside the conductive polymer 11 such that the first main electrode 12*a* and the second sub-electrode 12*d* are connected. A second internal through-electrode 17*b* has the same construction as that of the first internal through-electrode 17*a*. In FIGS. 6 (*a*) and (*b*), the same components as in FIG. 1 have the same reference numerals as in FIG. 1 and their description is omitted.

The first electrode can comprise both first side electrode 13*a* and first internal through-electrode 17*a.* Likewise, the second electrode is not limited to the second side electrode 13*b.* The second internal through-electrode 17*b* shown in FIG. 6 can be used as the second electrode. The second electrode can also comprise both second side electrode 13*b* and second internal through-electrode 17*b.*

The first and second sub-electrodes 12*b* and 12*d* are not indispensable components: the chip PTC thermistor can be made without them. Expansion of the conductive polymer 11 in the thickness direction under overcurrent is not prevented, without the sub-electrodes. However, with the sub-electrodes, reliability of the chip PTC thermistor improves.

In the aforementioned examples, either the cut-off section 14 or the opening 16 is provided to the first main electrode 12*a* as the means for releasing restriction against deformation. To achieve the same purpose, parts of the first main electrode 12*a* can be made weaker than the rest of it. The same holds true with the main electrode 12*c.*

The means for releasing restriction against deformation can be disposed anywhere in the first main electrode 12*a,* however, if it is disposed in an area furthest from the side electrode 13*a* which overlaps the opposing extension of the second main electrode 12*b,* a greater effect can be obtained. This can be applied to the means for releasing restriction against deformation provided to the second main electrode 12*c* in a corresponding area.

The Second Preferred Embodiment

The chip PTC thermistor of the second preferred embodiment of the present invention is described hereinafter with reference to the drawings.

Figure 7A:
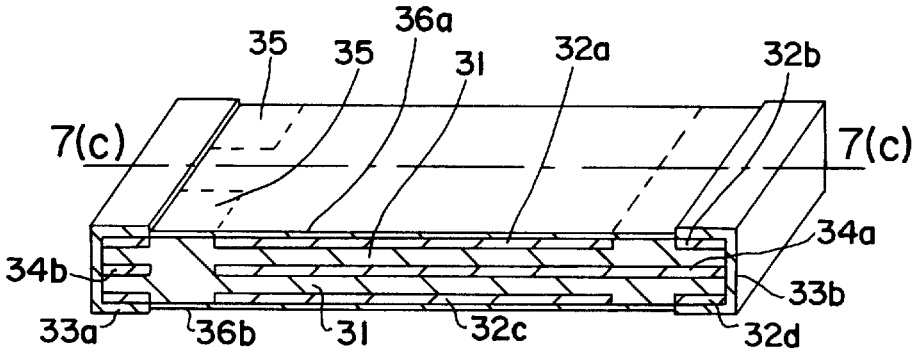
FIG. 7(*a*) is a perspective view of a chip PTC thermistor in accordance with a second preferred embodiment of the present invention.
Figure 7B:
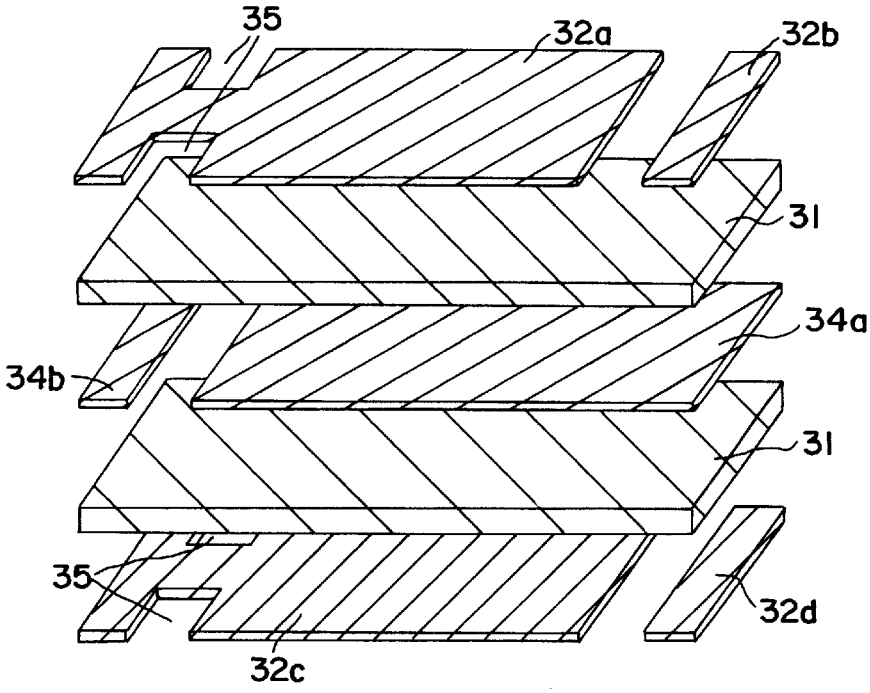
Figure 7C:
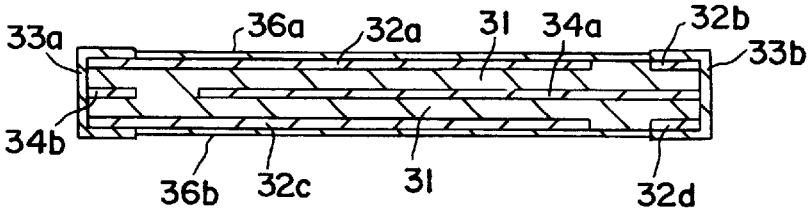

In FIGS. 7(*a*), 7(*b*) and 7(*c*), a rectangular parallelepiped conductive polymer 31 having PTC properties comprises a mixture of a high density polyethylene which is a crystalline polymer, and carbon black, a conductive particle. On a first face of the conductive polymer 31 is a first main electrode 32*a.* Also on the same plane is a first sub-electrode 32*b* which is disposed separately from the first main electrode 32*a.* A second main electrode 32*c* is disposed on a second face opposite the first face of the conductive polymer 31, and a second sub-electrode 32*d* is disposed separately from, but on the same plane as the second main electrode 32*c.* All the main and sub-electrodes 32*a,* 32*b,* 32*c,* and 32*d* are made with metal foil such as nickel and copper.

A first side electrode 33*a* made with a nickel plating layer folds around the entire surface of one of side faces of the conductive polymer 31 and edges of the first and second main electrodes 32*a* and 32*c* in such a manner that it electrically connects the first main electrodes 32*a* and 32*c.* A second side electrode 33*b* made with a nickel plating layer folds around the entire surface of the other side which is located opposite the first side electrode 33*a* of the conductive polymer 31, and edges of the first and second sub-electrodes 32*b* and 32*d* in such a manner that it electrically connects the first and second sub-electrodes 32*b* and 32*d.* An inner main electrode 34*a* is disposed inside the conductive polymer 31 parallel to the first and second main electrodes 32*a* and 32*c* and electrically connected to the second side electrode 33*b.* An inner sub-electrode 34*b* is disposed independently on a same plane as the inner main electrode 34*a,* and is electrically connected to the first side electrode 33*a.* These inner electrodes 34*a* and 34*b* are made with a metal foil such as copper and nickel.

The first and second main electrodes 32*a* and 32*c* have cut-off sections 35. First and second protective coatings 36*a* and 36*a* comprising epoxy-acrylic resins are formed on the outermost layer of the first and second faces of the conductive polymer 31.

Figure 8A:
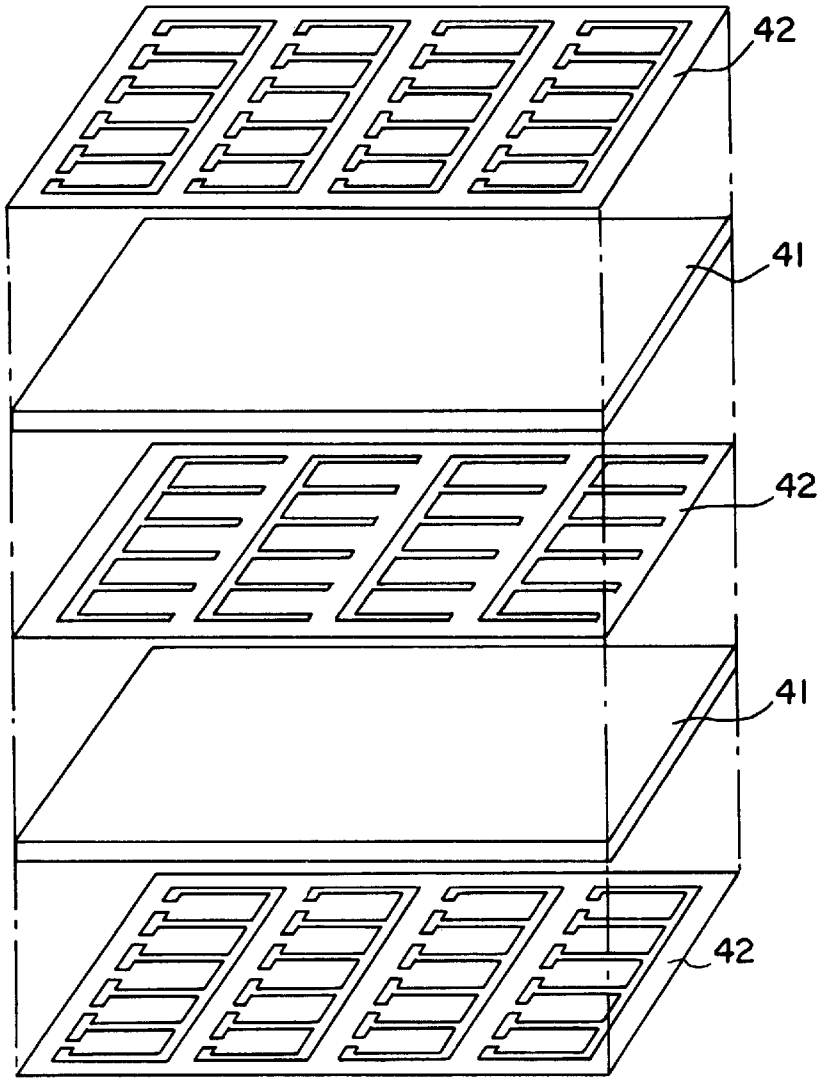
FIG. 8(*a*) show manufacturing process steps for forming the chip PTC thermistor in accordance with the second embodiment of the present invention.
Figure 8B:
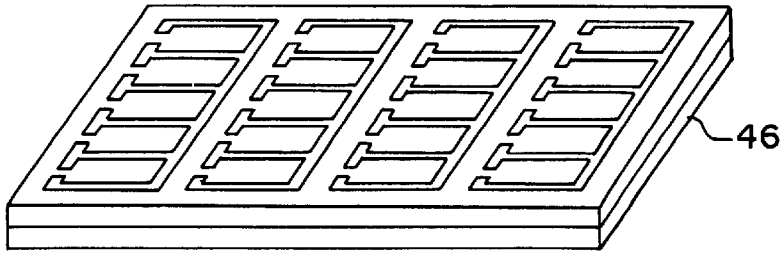

The following is an explanation of the manufacturing method of the chip PTC thermistor provided with reference to FIGS. 8(*a*) and 8(*b*).

First, conductive polymer sheets 41 and electrodes 42 are produced in the same manner as the first preferred embodiment. Second, the conductive polymer sheets 41 and the electrodes 42 are placed on the top of the other alternately as shown in FIG. 8(*a*). The laminate is then integrated by heating and pressing to form a first sheet 46 shown in FIG. 8(*b*). The following manufacturing steps for the chip PTC thermistor of this embodiment are the same as that of the first preferred embodiment.

In order to ensure that the chip PTC thermistor achieves an adequate rate of increase in resistance, a cut-off section is provided in the vicinity of the joint with the first side electrode to at least one of the first and second main electrodes disposed on each of the faces of the conductive polymer. Necessity of the cut-off section is described below taking the foregoing PTC thermister as an example.

According to the manufacturing method of the second preferred embodiment, two types of samples are made: a type of samples in which the first and second main electrodes 32*a* and 32*c* are provided with the cut-off sections 35 in the vicinity of the joint with the first side electrode 33*a* and another type of samples without the cut-off sections 35.

To confirm that the cut-off sections 35 provided to the predetermined positions bring about differences in the rate of increase in resistance, the same test as the first preferred embodiment is conducted as described below. Five samples of each of the aforementioned types are mounted on printed circuit boards in the same manner as the first preferred embodiment and kept in a constant temperature oven. The temperature of the oven was raised at the rate of 2° C./min from 25° C.–150° C. and resistances of the samples are measured at different temperatures. The results of the test confirms that the samples with the cut-off sections 35 have higher resistances than samples without the cut-off sections 35 when the temperature reaches 125° C.

Figure 9A:
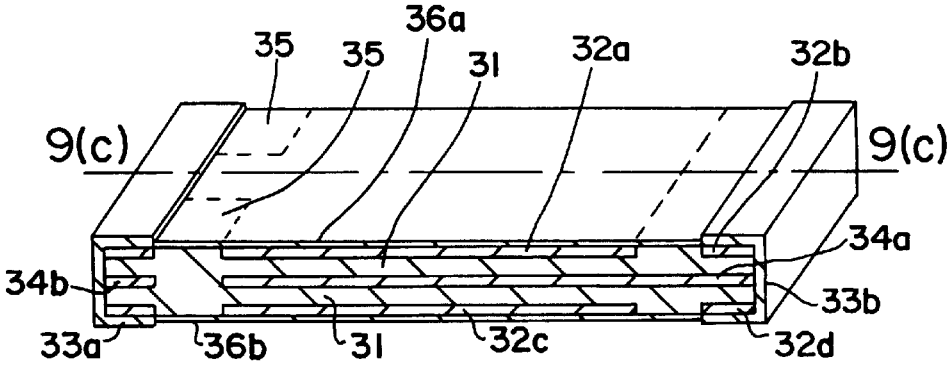
FIG. 9(*a*) is a perspective view of another chip PTC thermistor in accordance with the second preferred embodiment of the present invention.
Figure 9B:
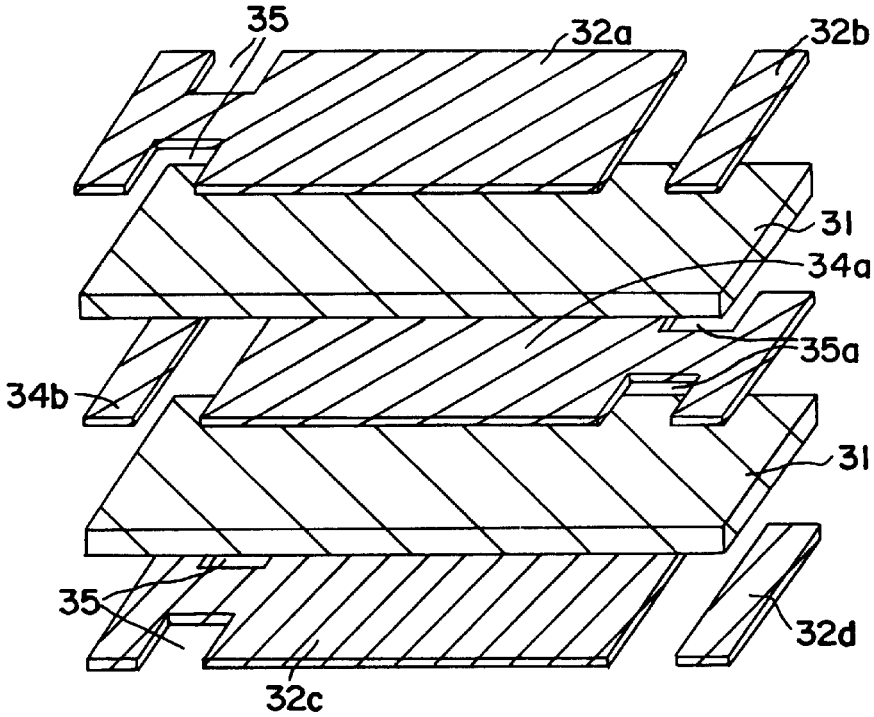
Figure 9C:
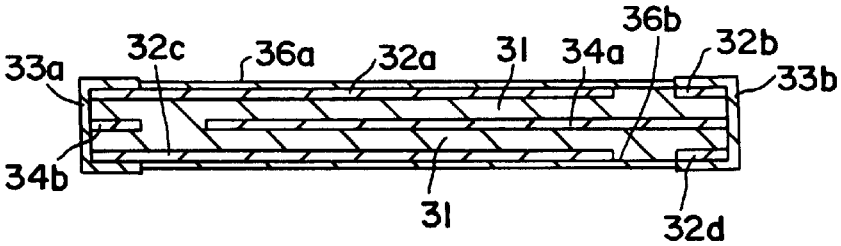

In the second preferred embodiment, the cut-off sections 35 are provided to the joints between the first and second main electrodes 32*a* and 32*c* and the first side electrode 33*a*. However, as shown in FIGS. 9(*a*)–(*c*), when the cut-off sections 35*a* are also provided to the vicinity of joint between the inner main electrode 34*a* and second side electrode 33*b*, even higher rate of increase in resistance can be obtained, thereby achieving higher effects.

Figure 10A:
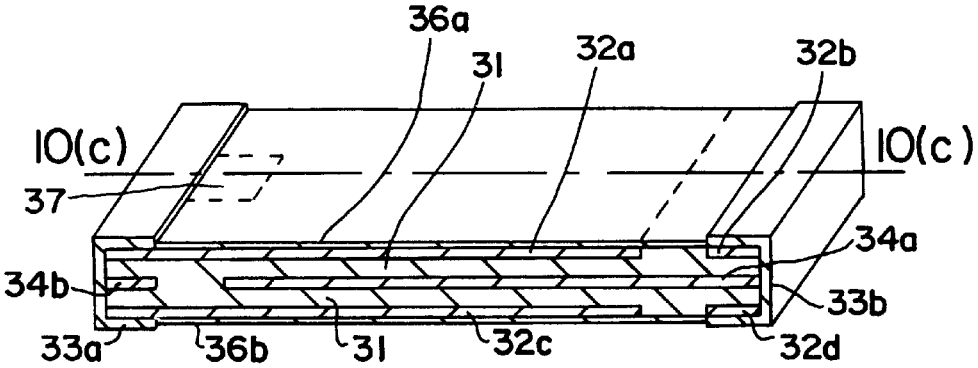
FIG. 10(*a*) is a perspective view of yet another chip PTC thermistor in accordance with the second preferred embodiment of the present invention.
Figure 10B:
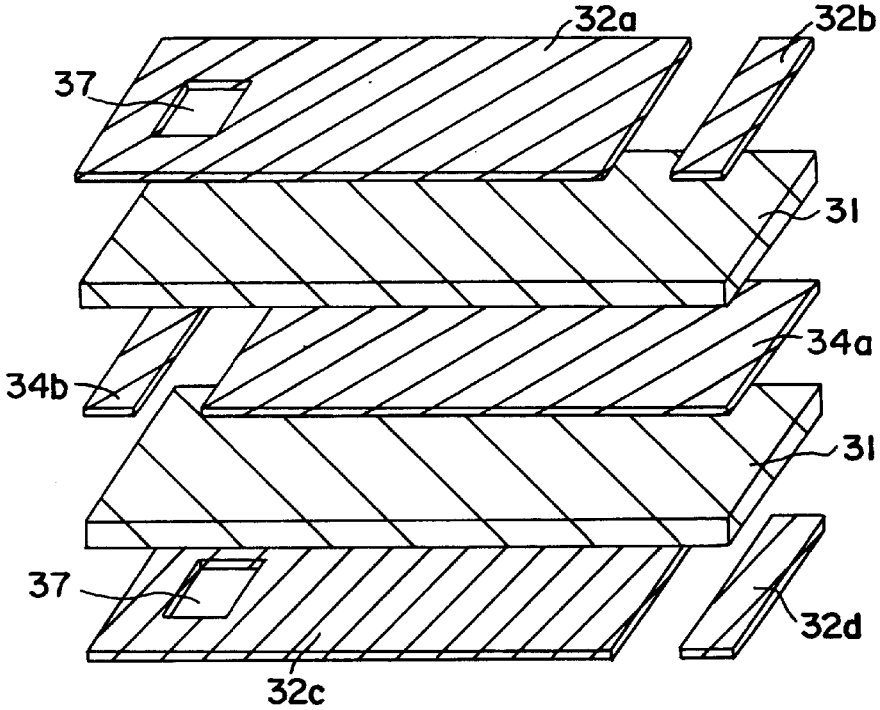
Figure 10C:
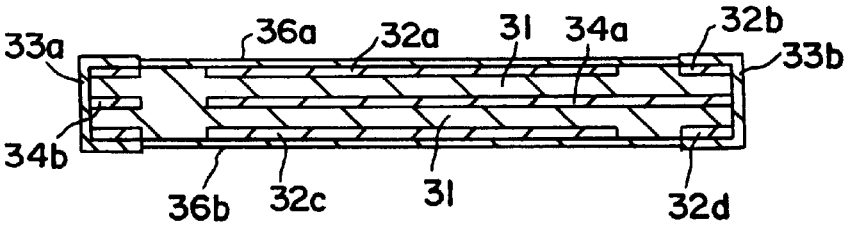
Figure 11A:
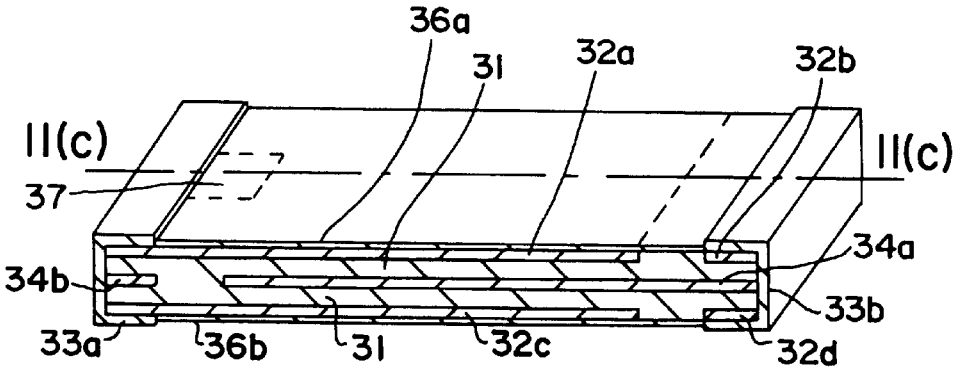
FIG. 11(*a*) is a perspective view of still another chip PTC thermistor in accordance with the second preferred embodiment of the present invention.
Figure 11B:
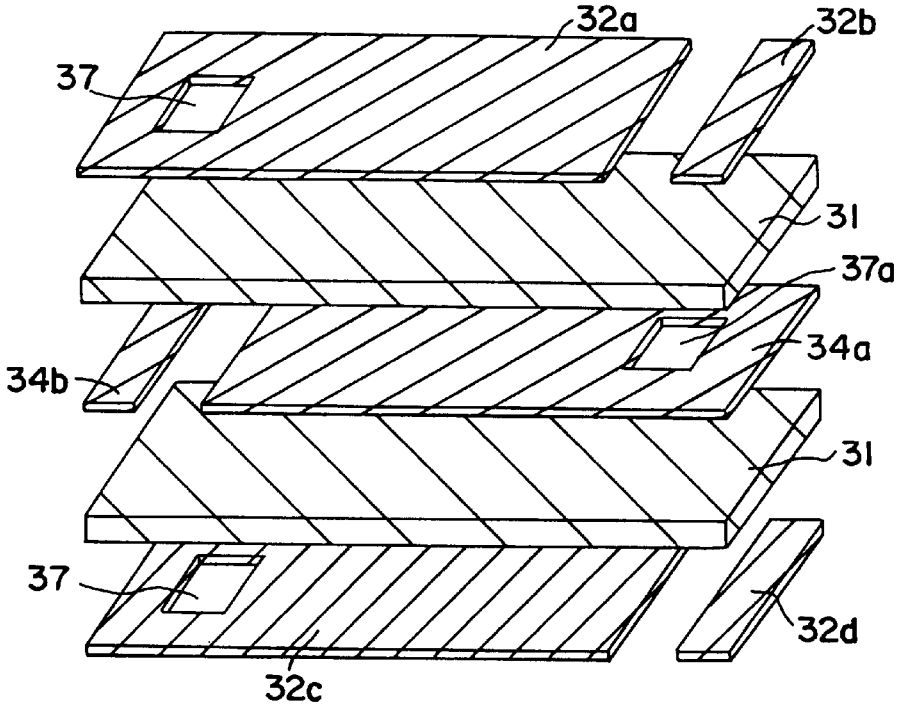
Figure 11C:
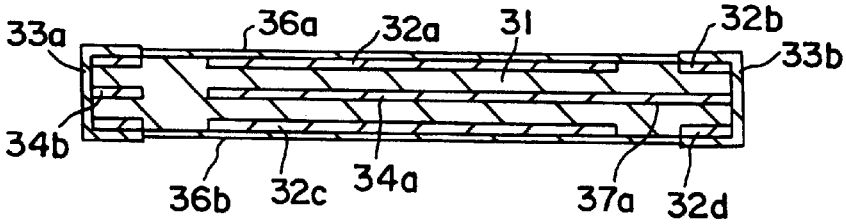

As shown in FIGS. 10(*a*)–(*c*), the cut-off sections 35 can be replaced with openings 37 for obtaining the same effects. As shown in FIGS. 11(*a*)–(*c*), it is preferable to provide openings 37*a* in addition to the openings 37, to the inner main electrode 34*a*.

In the second preferred embodiment, a chip PTC thermistor with the cut-off sections 35 or the openings 37 provided on both first and second main electrodes 32*a* and 32*c* is described. However, it is also possible to provide the cut-off sections 35 to one of the first and second main electrodes 32*a* and 32*c* and more than one opening 37 to the other main electrode.

In the second preferred embodiment, the chip PTC thermistor having one inner main electrode 34*a* and one inner sub-electrode 34*b* disposed inside the conductive polymer 31 is described. This construction can be applied to chip PTC thermistors comprising 3, 5 or other odd-numbered inner main electrodes and odd-numbered inner sub-electrodes disposed inside the conductive polymer. In the case of such chip PTC thermistor, either cut-off sections or openings or both of them can be provided to the odd-numbered (more than 3) inner main electrodes depending on the needs.

In the second preferred embodiment, the chip PTC thermistor is provided with the inner sub-electrode 34*b*, however, it is not an indispensable component.

Further, the first electrode does not have to comprise an electrode disposed over the entire face of the conductive polymer 31 like the first side electrode 33*a*: it can comprise an electrode partially covering the side face, or an internal through-electrode, or a combination of the side electrode and the internal through-electrode.

The means for releasing restriction against deformation does not have to be a cut-off section or an opening. The first main electrode 12*a* can be provided with partly weaker portion than the rest of it.

In the same manner as the first preferred embodiment, a larger effect can be obtained if the means for releasing restriction against deformation disposed in the first main electrode 32*a* is also disposed in an area furthest from the side electrode 33*a* which overlaps the opposing extension of the inner main electrode 34*a*. This configuration can be applied to the second side electrode 33*b* and the inner main electrode 34*a* in a corresponding area.

The Third Preferred Embodiment

The chip PTC thermistor of the third preferred embodiment of the present invention is described hereinafter with reference to the attached drawings.

Figure 12A:
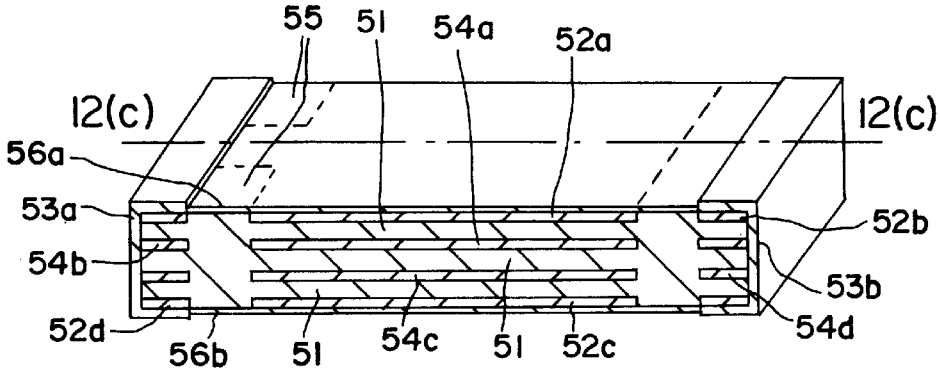
FIG. 12(*a*) is a perspective view of a chip PTC thrmistor in accordance with a third preferred embodiment of the present invention.
Figure 12B:
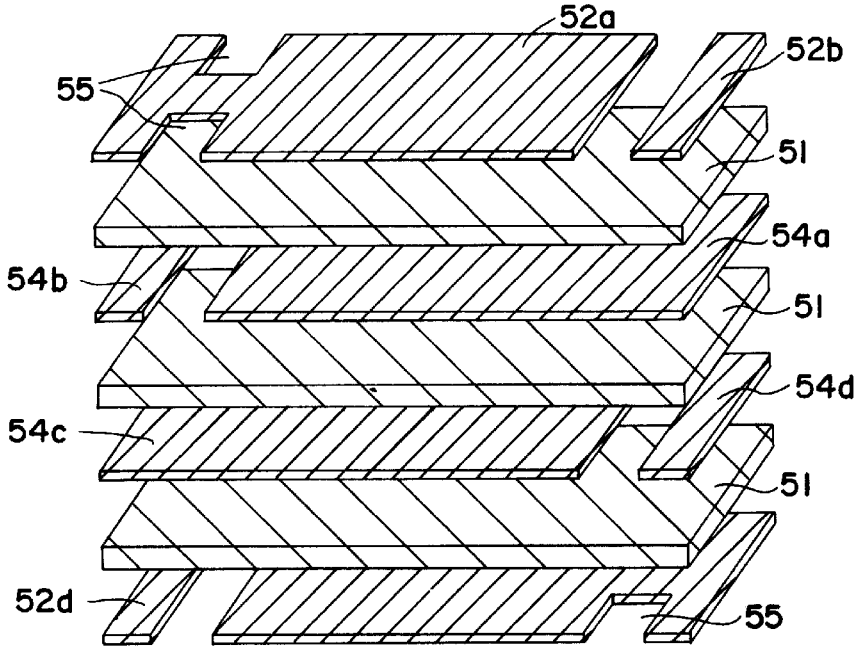
Figure 12C:
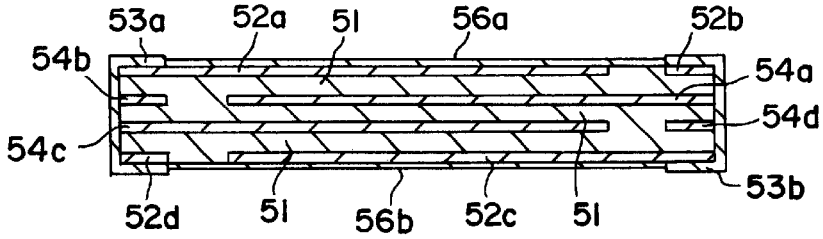

In FIGS. 12(*a*), 12(*b*) and 12(*c*), a rectangular parallelepiped conductive polymer 51 having. PTC properties comprises a mixture of a high density polyethylene which is a crystalline polymer, and carbon black, a conductive particle. On a first face of the conductive polymer 51 is a first main electrode 52*a*. Also on the same face is a first sub-electrode 52*b* which is disposed separately from the first main electrode 52*a*. A second main electrode 52*c* is disposed on a second face opposite the first face of the conductive polymer 51, and a second sub-electrode 52*d* is disposed separately on the same face as the second main electrode 52*c*. All the main and sub-electrodes 52*a*, 52*b*, 52*c*, and 52*d* are made with metal foil such as nickel and copper.

A first side electrode 53*a* made with a nickel plating layer folds around the entire surface of one of side faces of the conductive polymer 51 and the edges of the first main electrode 52*a* and the second sub-electrode 52*d* in such a manner that it electrically connects the first main electrode 52*a* and the second sub-electrode 52*d*. A second side electrode 53*b* made with a nickel plating layer folds around the entire surface of the other side face which is opposite the first side electrode 53*a* of the conductive polymer 51, and the edge of the second main electrode 52*c* and the first sub-electrode 52*b* in such a manner that it electrically connects the second main electrode 52*c* and the first sub-electrode 52*b*.

A first inner main electrode 54*a* is disposed inside the conductive polymer 51 parallel to the first and second main electrodes 52*a* and 52*c* and electrically connected to the second side electrode 53*b*. A first inner sub-electrode 54*b* is disposed separately on the same plane as the inner main electrode 54*a*, and is electrically connected to the first side electrode 53*a*. A second inner main electrode 54c is disposed inside the conductive polymer 51 parallel to the first and second main electrodes 52*a* and 52*c* and electrically connected to the first side electrode 53*a*. A second inner sub-electrode 54*d* is disposed separately on the same plane as the inner main electrode 54*a*, and is electrically connected to the second side electrode 53*b*. These inner electrodes 54*a*, 54*b*, 54*c* and 54*d* are made with a metal foil such as copper and nickel.

The first and second main electrodes 52*a* and 52*c* have cut-off sections 55. First and second protective coatings 56*a* and 56*a* comprising epoxy-acrylic resins are formed on the outermost layers of the first and second faces of the conductive polymer 51.

Figure 13A:
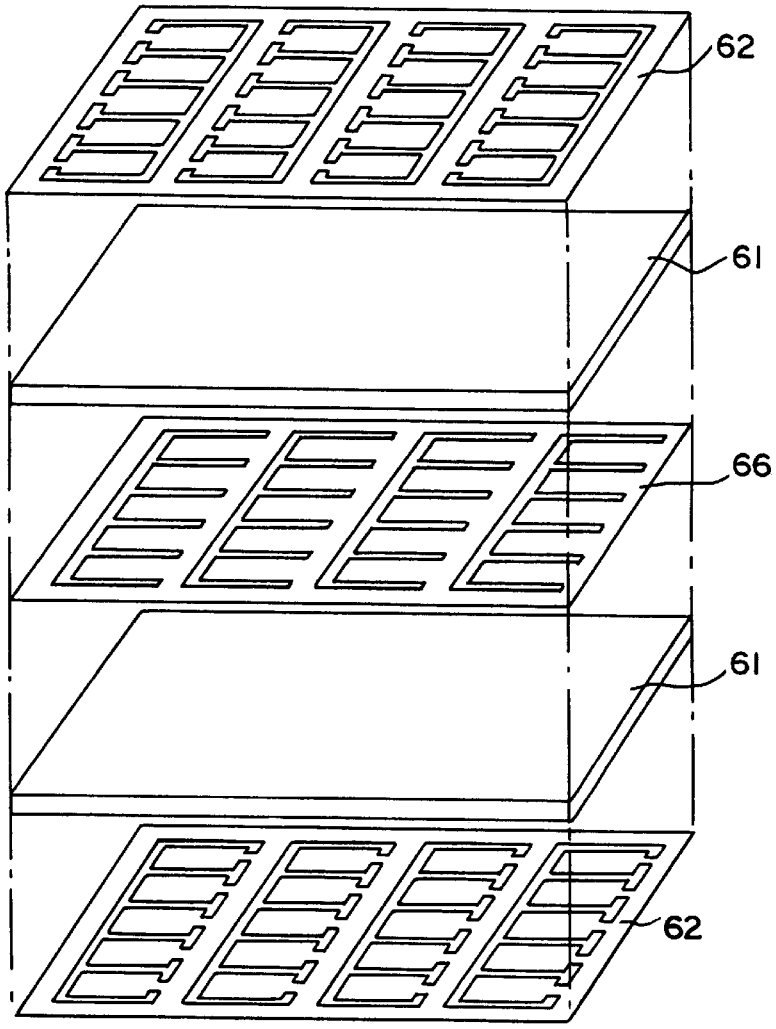
FIG. 13(*a*) show manufacturing process for forming the chip PTC thermistor in accordance with the third preferred embodiment of the present invention.
Figure 13B:
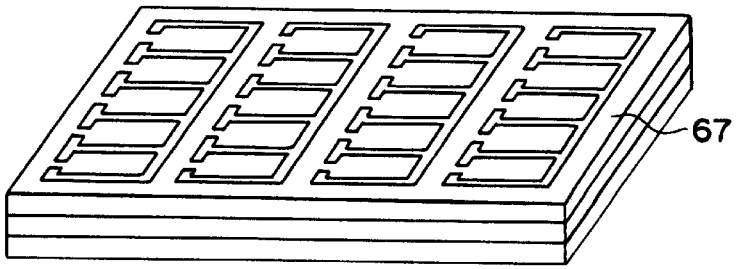

The manufacturing method of the chip PTC thermistor constructed in the foregoing manner is described with reference to FIGS. 13(*a*) and (*b*).

First, conductive polymer sheets 61 and electrodes 62 are produced. The conductive polymer sheet 61 is sandwiched between the electrodes 62 and heat pressed in a vacuum to form an integrated first sheet 66 as in the first preferred embodiment. Second, as shown in FIG. 13(*a*), the conductive polymer sheets 61 and the electrodes 62 are stacked alternatively on the top and bottom of the first sheet 66 such that the electrodes 62 form outermost layers. The laminate is then heat pressed to form a second sheet 67 shown in FIG. 13(*b*). Subsequently, by following the same manufacturing steps as those of the first preferred embodiment, a chip PTC thermistor is produced.

In order to ensure that the chip PTC thermistor achieves an adequate rate of increase in resistance, a cut-off section needs to be formed on one of or both of the first and second main electrodes in the vicinity of the joints with either one or both of the first and second side electrodes. The reason why the cut-off section is required is described below using samples prepared for comparison.

According to the manufacturing method of the third preferred embodiment, two types of samples are made: a type of samples in which the first and second main electrodes 52*a* and 52*c* are provided with the cut-off sections 55 in the vicinity of the joints with the first and second side electrodes 53*a* and 53*b* and another type of samples without the cut-off sections 55. To confirm that the cut-off sections 55 bring about differences in the rate of increase in resistance, the same test as the first preferred embodiment is conducted as described below. Five samples of each of the aforementioned types are prepared, and are mounted on printed circuit boards and kept in a constant temperature oven. The temperature of the oven is raised at the rate of 2° C./min from 25° C.–150° C. and resistances of the samples are measured at different temperatures. The results of the test confirm that the samples with the cut-off sections 55 have higher resistances than samples without cut-off sections 55 when the temperature reaches to 125° C.

Figure 14A:
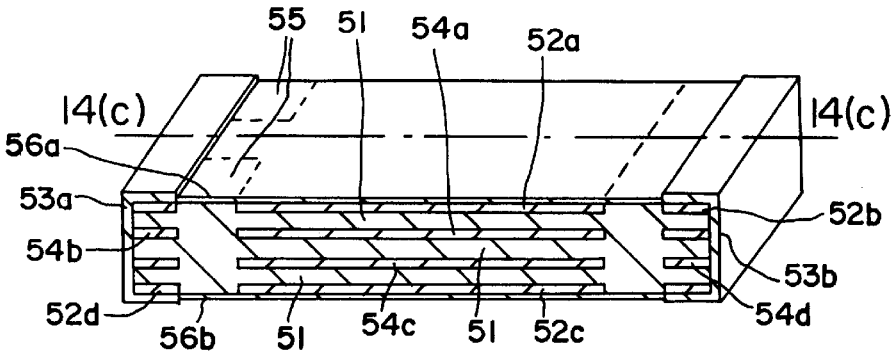
FIG. 14(*a*) is a perspective view of another chip PTC thermistor in accordance with the third preferred embodiment of the present invention.
Figure 14B:
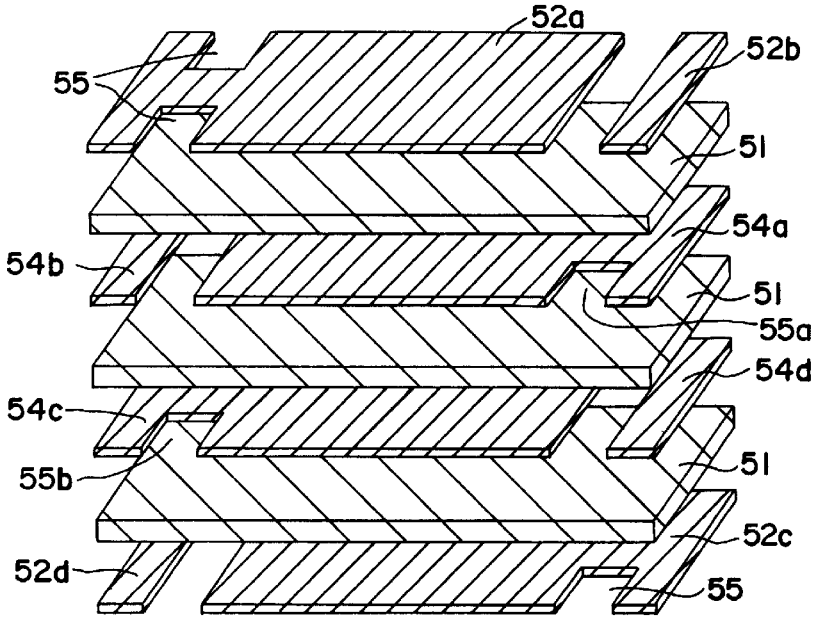
Figure 14C:
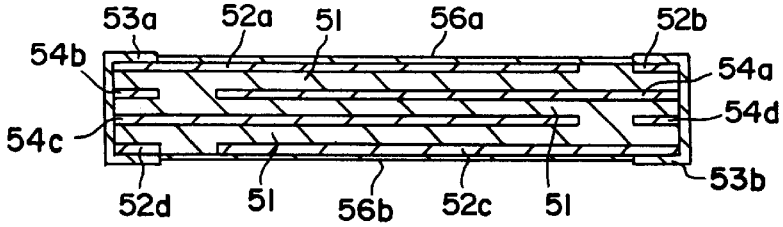
Figure 15A:
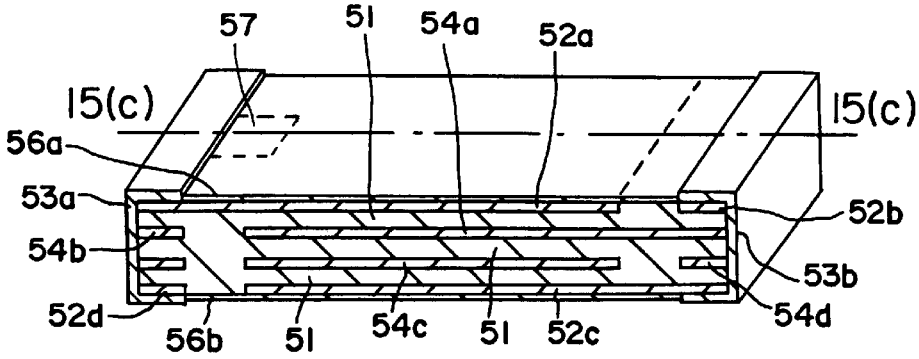
FIG. 15(*a*) is a perspective view of yet another chip PTC thermistor in accordance with the third preferred embodiment of the present invention.
Figure 15B:
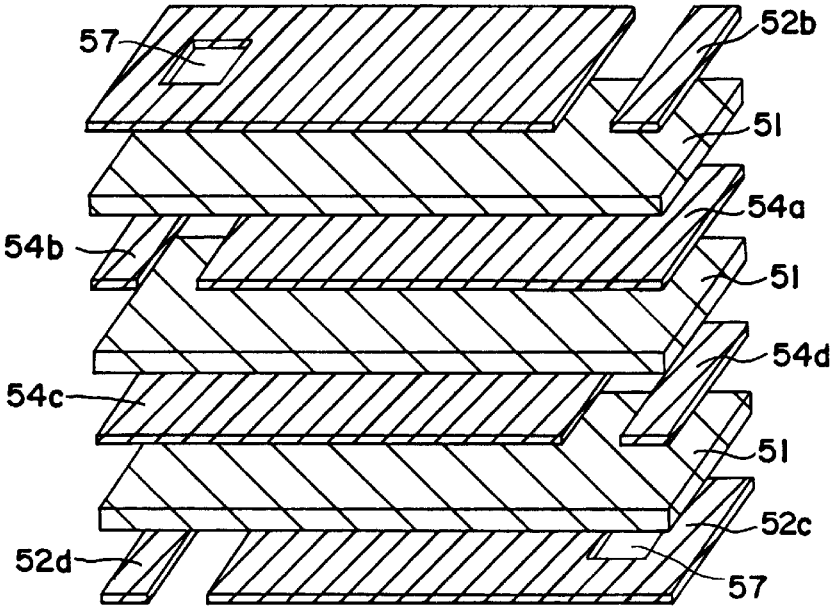
Figure 15C:
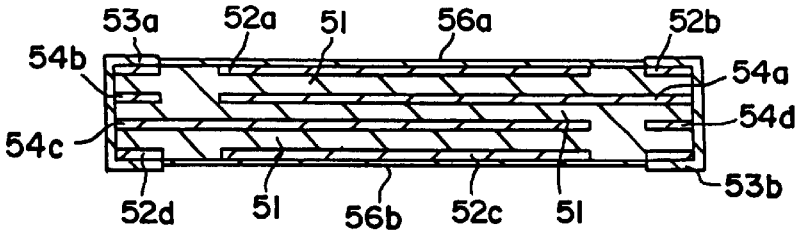
Figure 16A:
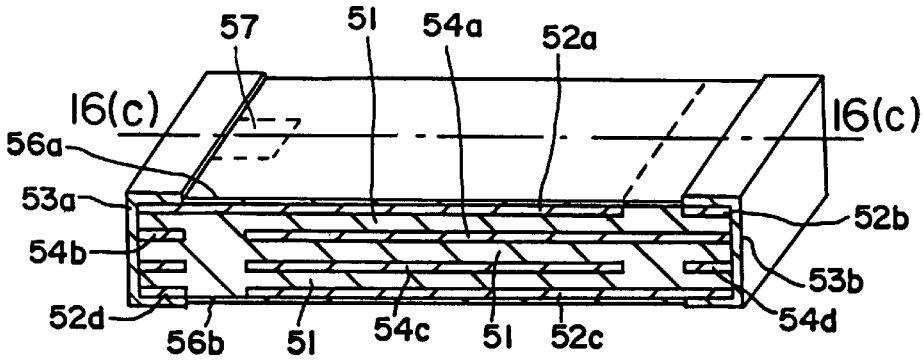
FIG. 16(*b*) is an exploded perspective view of the chip PTC thermistor in accordance with the third preferred embodiment of the present invention.
Figure 16B:
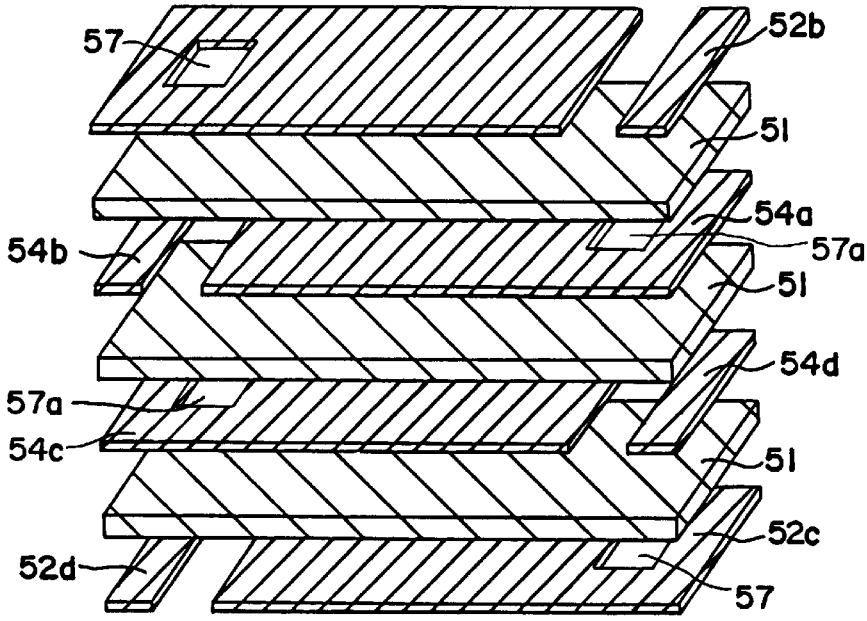
Figure 16C:
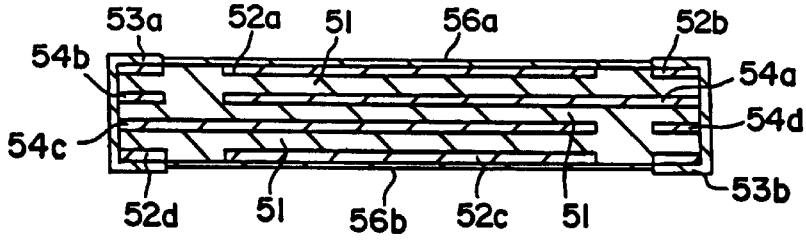

In the description of the third preferred embodiment, the cut-off sections 55 are provided to the first and second main electrodes 52*a* and 52*c* in the vicinity of the joints with the first and second side electrodes 53*a* and 53*b*. However, as shown in FIGS. 14(*a*)–(*c*), it is preferable to provide cut-off sections 55*a* and 55*b* to the first and second inner main electrodes 54*a* and 54*c* in the vicinity of joints between them and the second side and first side electrodes 53*b* and 53*a*. As shown in FIGS. 15(*a*)–(*c*), the cut-off sections 55 can be replaced with openings 57 for obtaining the same effects. As shown in FIGS. 16 (*a*)–(*c*), it is preferable to provide openings 57*a* to the first and second inner main electrodes 54*a* and 54*c* in the vicinity of the joints between them and the first and second side electrodes 53*a* and 53*b*.

In the description of the third preferred embodiment, either the cut-off sections 55 or the openings 57 are provided to both first and second main electrodes 52*a* and 52*c* is described. However, it is also possible to provide the cut-off sections 55 to one of the first and second main electrodes 52*a* and 52*c* and more than one opening 57 to the other main electrode.

In the third preferred embodiment, the chip PTC thermistor having two inner main electrodes 54*a* and 54*c* and two inner sub-electrodes 54*b* and 54*d* is described. However, the even-numbered (such as 4 and 6) inner main and sub-electrodes can be disposed inside the conductive polymer. In the case of the chip PTC thermistor with the even-numbered (two or more) inner main and sub-electrodes, either one of cut-off sections 55 and openings 57 or both can be provided to the inner main electrodes depending on the needs.

In the third preferred embodiment, the chip PTC thermistor is provided with the first and second inner sub-electrodes 54*b* and 54*d,* however, the present invention can be applied to a chip PTC thermistor without the first and second inner sub-electrodes 54*b* and 54*d.*

Figure 17A:
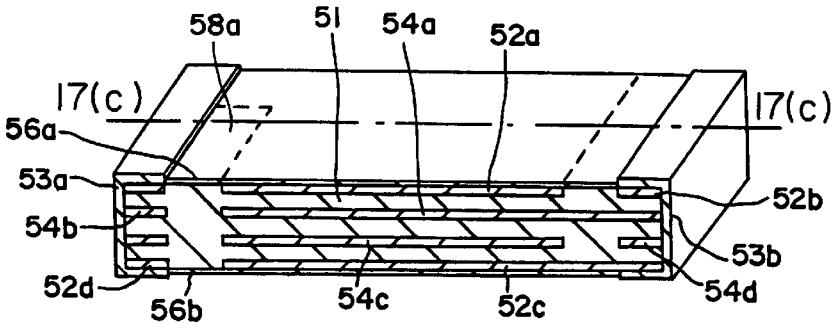
FIG. 17(*a*) is a perspective view of still another chip PTC thermistor in accordance with the third preferred embodiment of the present invention.
Figure 17B:
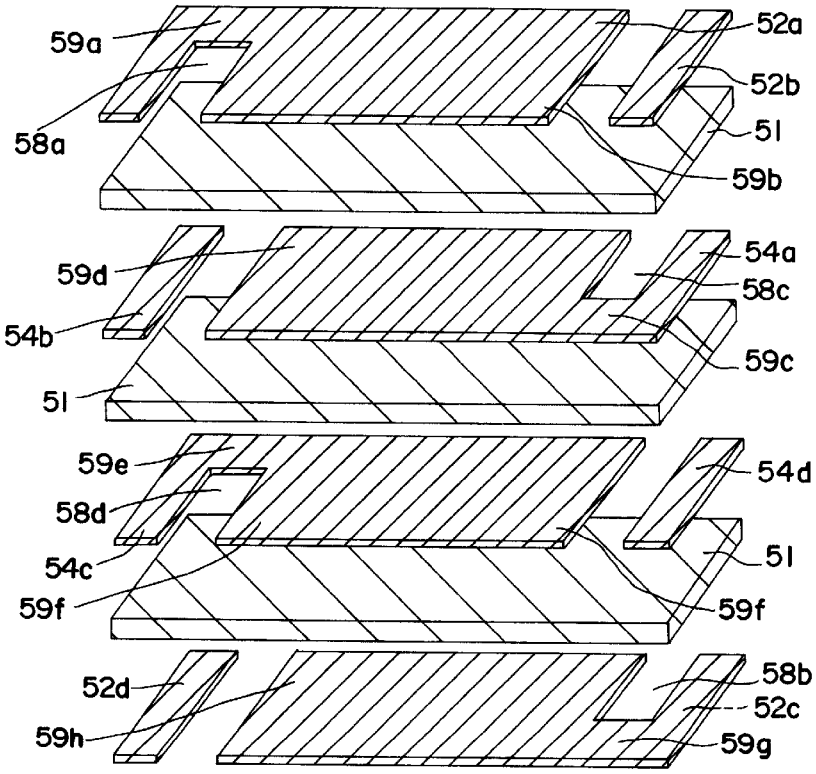
Figure 17C:
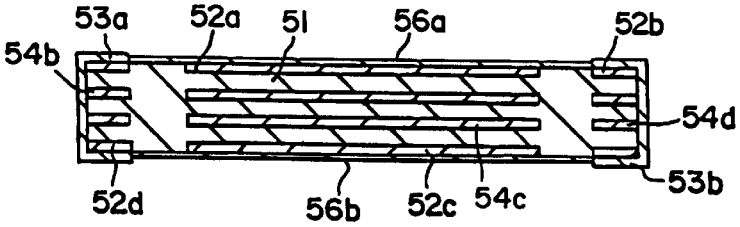
Figure 18A:
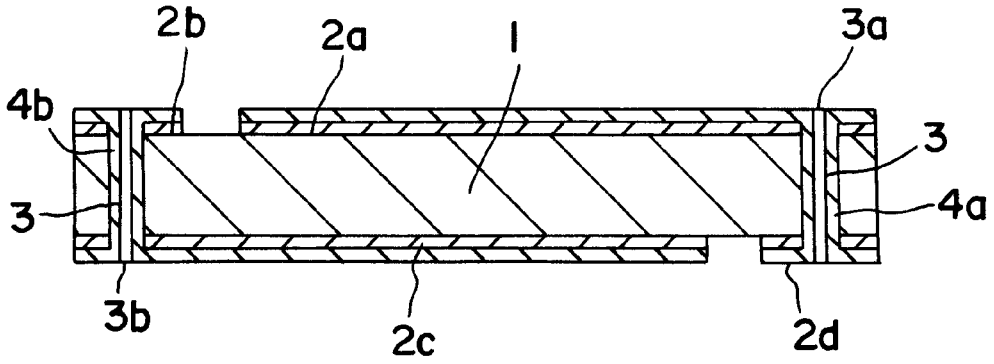
FIGS. 18(*a*) and (*b*) are respectively a sectional view and a top view of a conventional chip PTC thermistor.
Figure 18B:
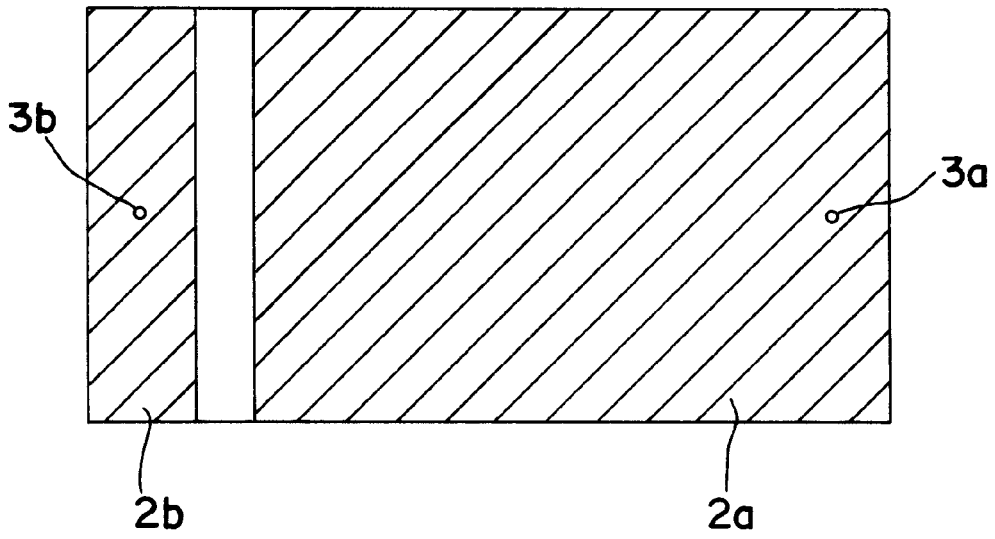

The shape of the means for releasing restriction against deformation is not limited to the shapes of cut-off sections 55 and the openings 57. The shape of cut-off sections 58*a,* 58*b,* 58*c* and 58*d* shown in FIG. 17, which are formed from one of the sides parallel to the longitudinal direction of the electrodes, can also be applicable. The cut-off sections 58*a,* 58*b,* 58*c* and 58*d* are means for releasing restriction against deformation respectively provided to the first and second main electrodes 52*a* and 52*c* and the first and second inner main electrodes 54*a* and 54*c*. While the cut-off sections 55 shown in FIG. 12 are provided on both of the longitudinal sides of the layer, the cut-off sections 58*a*–58*d* in FIG. 17 are provided on only one of the longitudinal sides of each layer. In other words, in FIG. 12. the first main electrode 52*a* has only a narrow part remaining in the middle where the cut-off sections 55 are provided from both of its longitudinal sides. Conversely, in the case of the cut-off section 58*a,* the first main electrode 52*a* in FIG. 17 has one side remaining intact. Therefore, the shape of the first main electrode 52 in FIG. 17 is more susceptible to deformation, thus is less capable of restraining the expansion of the conductive polymer 51. Due to this, the resistance increases more sharply when an overcurrent is applied. This shape of the means for releasing restriction against deformation can be applied not only to the first main electrode 52*a* but also to the second main electrode 52*c,* the first and second inner main electrodes 54*a* and 54*c* to achieve even greater effects. This kind of shape can also be applied to the chip PTC thermistors in the first and second preferred embodiments, and similar higher effects as the third preferred embodiment can be obtained.

As shown in FIG. 17, the cut-off sections 58*a*–58*d* used as the means for releasing restriction against deformation are disposed rotationally symmetrically with one another in the following manner:

the cut-off section 58*a* disposed on the first main electrode 52*a* is rotationally symmetrical to the cut-off section 58*c* disposed on the first inner electrode 54*a* adjacent to the first main electrode 52*a;* the cut-off section 58*c,* to the cut-off section 58*d* disposed on the second inner main electrode 54*c* adjacent to the first inner electrode 54*a;* and cut-off section 58*d,* to the cut-off section 58*b.* Rotation axis, a reference point for the rotational symmetry, lies in the direction to which the first main electrode 52*a,* the conductive polymer 51 and the first inner main electrode 54*a* and the like are laminated. In other words, the rotation axis of the rotation symmetry in this case is the direction perpendicular to the plain of the first main electrode 52*a.*

As described above, it is preferable to dispose the means for releasing restriction against deformation in a rotationally symmetrical manner. The reason for this is described below.

The displacement of the electrode caused by the expansion of the conductive polymer 51 and the position of the means for releasing restriction against deformation have the following relationship:

in the area of the first main electrode 52*a,* which extends from the part where the cut-off section 58*a* is provided to the tip adjacent to the first sub-electrode 52*b,* an adjacent section

59*a* adjacent to the cut-off section 58*a* suffers the least amount of deformation caused by the expansion of the conductive polymer 51; and conversely, a tip section 59*b* located at the edge farthermost away from the section 59*a* suffers the largest amount of deformation.

The same relationship is observed in the case of the first and second inner main electrodes 54*a* and 54*c,* and the second main electrode 52*c,* i.e. the largest deformation is observed in the adjacent sections 59*c,* 59*e* and 59*g,* and least deformation, tip sections 59*d,* 59*f* and 59*h.*

According to the configuration shown in FIG. 17, the adjacent sections 59*a,* 59*c,* 59*e* and 59*g* and the tip sections 59*b,* 59*d,* 59*f,* and 59*h* are alternately placed such that they face each other via the conductive polymer 51. This configuration allows the deformation of the chip PTC thermistor as a whole to be even, thereby improving the reliability. If the cut-off sections 58*c* and 58*b* are formed on the front side of the figure, in other words, if the first inner main electrode 54*a* and second main electrode 52*c* are inverted along the A—A line set as the line of symmetry, the conductive polymer 51 on the front side expands more easily than the conductive polymer 51 located in the back. Due to this, the level of the deformation of the chip PTC thermistor in the front side becomes larger, and in the back, smaller, making the amounts of the deformation uneven. Consequently, downward power is imposed on the first side electrode 53*a* in the front side, and in the back, upward power is imposed. As a result, the reliability of the joint between the first side electrode 53*a* and the first main electrode 52*a* is lowered.

The rotational symmetrical configuration of the means for releasing restriction against deformation described in the third preferred description can be applied to the first and second preferred embodiment for obtaining the same effects.

In the first, second and third preferred embodiments, the first main electrode 52*a,* the firs sub-electrode 52*b,* the second main electrode 52*c,* the second sub-electrode 52*d,* the first inner main electrode 54*a,* the first inner sub-electrode 54*b,* the second inner main electrode 54*c,* and the second inner sub-electrode 54*d* are made with conductive materials comprising metal foil. The present invention can also be applied to conductive materials made by sputtering, thermal spraying, and plating, conductive materials made by plating after sputtering or thermal spraying, and conductive sheets. Preferable conductive sheets include a sheet including one of metal powder, metal oxides, conductive nitrides or carbides and carbon, and a sheet including one of metal mesh, metal powder, metal oxides, conductive nitrides or carbides and carbon.

Industrial Applicability

The chip PTC thermistor of the present invention is superior in rate of increase in resistance and withstand voltage when overcurrent is applied, and highly applicable to the industry.

What is claimed is:

1. A thermistor having a known breakdown voltage based on physical device characteristics, comprising:

a conductive polymer substrate having a positive temperature coefficient (PTC);

a first main electrode disposed along a first surface of the substrate;

second main electrode disposed along a second surface of the substrate, the second surface opposing the first surface so that portions of said first and second main electrodes oppose each other, and at least one of said first and second main electrodes having first and second cut-off sections, each of said first and second cut-off sections extending from an edge of the at least one of said first and second electrodes and being spaced oppositely from each other, and each of said first and second cut-off sections do not face said opposing main electrodes.

2. A thermistor having a known breakdown voltage based on physical device characteristics, comprising:

a conductive polymer substrate having a positive temperature coefficient(PTC);

a first main electrode disposed along a first surface of the substrate;

a second main electrode disposed along a second surface of the substrate, the second surface opposing the first surface so that portions of said first and second main electrodes oppose each other, the path between the first main electrode and second main electrode defining a current path through the substrate;

a first restriction joint extending along the direction of the current path for restricting deformation of the substrate;

a second restriction joint opposing the first restriction joint and extending along the direction of the current path for restricting deformation of the substrate; and at least one of said first and second main electrodes having first and second cut-off sections, each of said first and second cut-off sections extending from an edge of the at least one of said first and second electrodes and being spaced oppositely from each other, and each of said first and second cut-off sections do not face said opposing main electrode.

3. A thermistor having a known breakdown voltage based on physical device characteristics, comprising:

a conductive polymer substrate having a positive temperature coefficient (PTC);

a first main electrode disposed along a first surface of the substrate;

a second main electrode disposed along a second surface of the substrate, the second surface opposing the first surface so that portions of said first and second main electrodes oppose each other, the path between the first main electrode and second main electrode defining a current path through the substrate;

a first electrode disposed along the first surface and electrically connected to the first main electrode;

a second electrode disposed along the second surface and electrically connected to the second main electrode;

a first restriction joint extending along the current path for restricting deformation of the substrate and electrically connecting the first main electrode to the second electrode;

a second restriction joint opposing the first restriction joint and extending along the circuit path for restricting deformation of the substrate and electrically connecting the second main electrode to the first electrode; and at least one of said first and second main electrodes having first and second cut-off sections, each of said first and second cut-off sections extending from an edge of the at least one of said first and second electrodes and being spaced oppositely from each other, and each of said first and second cut-off sections do not face said opposing main electrode.

* * * * *